US011666904B2

(12) United States Patent
Ono et al.

(10) Patent No.: US 11,666,904 B2
(45) Date of Patent: Jun. 6, 2023

(54) FLUID HANDLING SYSTEM

(71) Applicant: Enplas Corporation, Saitama (JP)

(72) Inventors: Koichi Ono, Saitama (JP); Hayato Inoue, Saitama (JP); Tomoki Nakao, Saitama (JP); Seiichiro Suzuki, Saitama (JP)

(73) Assignee: Enplas Corporation, Saitama (JP)

( * ) Notice: Subject to any disclaimer, the term of this patent is extended or adjusted under 35 U.S.C. 154(b) by 15 days.

(21) Appl. No.: 17/387,149

(22) Filed: Jul. 28, 2021

(65) Prior Publication Data

US 2023/0034176 A1 Feb. 2, 2023

(51) Int. Cl.
*B01L 3/00* (2006.01)

(52) U.S. Cl.
CPC ... *B01L 3/502707* (2013.01); *B01L 3/502746* (2013.01); *B01L 2200/0689* (2013.01); *B01L 2300/123* (2013.01)

(58) Field of Classification Search
None
See application file for complete search history.

(56) References Cited

U.S. PATENT DOCUMENTS 6,698,798 B2 * 3/2004 Tai ..... B81B 1/006 285/345
7,311,882 B1 * 12/2007 Renzi ..... B01L 3/565 422/546
2003/0173781 A1 9/2003 Dodgson
2006/0257263 A1 * 11/2006 Ito ..... B01F 25/31322 417/3
2010/0322826 A1 * 12/2010 Locascio ..... B01L 3/502715 422/537
2013/0234432 A1 * 9/2013 Graham ..... F16L 19/0237 285/136.1
2018/0229239 A1 * 8/2018 Cauley ..... B01F 23/4105

FOREIGN PATENT DOCUMENTS

WO WO2017201462 A1 * 11/2017 ..... B01L 3/00

* cited by examiner

*Primary Examiner* — Lore R Jarrett
(74) *Attorney, Agent, or Firm* — Shih IP Law Group, PLLC

(57) ABSTRACT

A fluid handling system includes a fluid handling device including an opening for introducing a fluid or discharging the fluid; a tube including a flange, where one end of the tube is for connection to the opening, and the other end of the tube is for connection to an introduction device for supplying the fluid or to a discharge device for discharging the fluid; a support member including a first through hole into which the tube is inserted, and movably supporting the tube; and a first elastic member including a second through hole into which the tube is inserted, and holding a part of the tube while the first elastic member is in contact with the flange and the fluid handling device or the support member.

9 Claims, 15 Drawing Sheets

FLUID HANDLING SYSTEM

TECHNICAL FIELD

The present invention relates to a fluid handling system.

BACKGROUND ART

In recent years, microwell plates, channel chips, and the like have been used to analyze cells, proteins, and nucleic acids. Microwell plates and channel chips have the advantage of requiring only a small amount of reagents and samples for analysis, and are expected to be used in a variety of applications such as clinical tests, food tests, and environment tests.

For example, Patent Literature (hereinafter abbreviated as "PTL") 1 describes a microchannel assembly that includes a microfluidic device. Connectors are disposed at the inlet and the outlet of the microfluidic device, respectively. The microchannel assembly described in PTL 1 is connected to an external liquid supply device or the like by connecting, for example, tubes to the connectors.

CITATION LIST

Patent Literature

PTL 1
US Patent Application Publication No. 2003/0173781

SUMMARY OF INVENTION

Technical Problem

In the microchannel assembly descried in PTL 1, the positions and angles of the tubes should be adjusted individually for connecting to corresponding connectors, which can result in some connectors being poorly connected to the corresponding tubes, and thus in liquid leakage.

An object of the present invention is to provide a fluid handling system—even when the system includes a plurality of openings—capable of properly connecting insertion tubes to the openings without having to adjust the positions and angles of insertion tubes individually, and in the fluid handling system, liquid leakage is less likely to occur.

Solution to Problem

A fluid handling system according to an embodiment of the present invention includes a fluid handling device including a fluid operation part for introducing a fluid or discharging the fluid; a tube including a flange, and one end of the tube is for connection to the fluid handling device, and the other end of the tube is for connection to an introduction device for supplying the fluid or to a discharge device for discharging the fluid; a support member including a first through hole, to which the tube is engaged, and movably supporting the tube; and a first elastic member including a second through hole, into which the tube is inserted, and coming into contact with the flange and the fluid handling device or the support member.

Advantageous Effects of Invention

The present invention provides a fluid handling system that can readily connect a fluid handling device to an external device without causing fluid leakage.

DESCRIPTION OF EMBODIMENTS

Hereinafter, fluid handling systems according to the embodiments of the present invention will be described in detail with reference to the drawings.

Embodiment 1

Configuration of Fluid Handling System

Figure 1A:
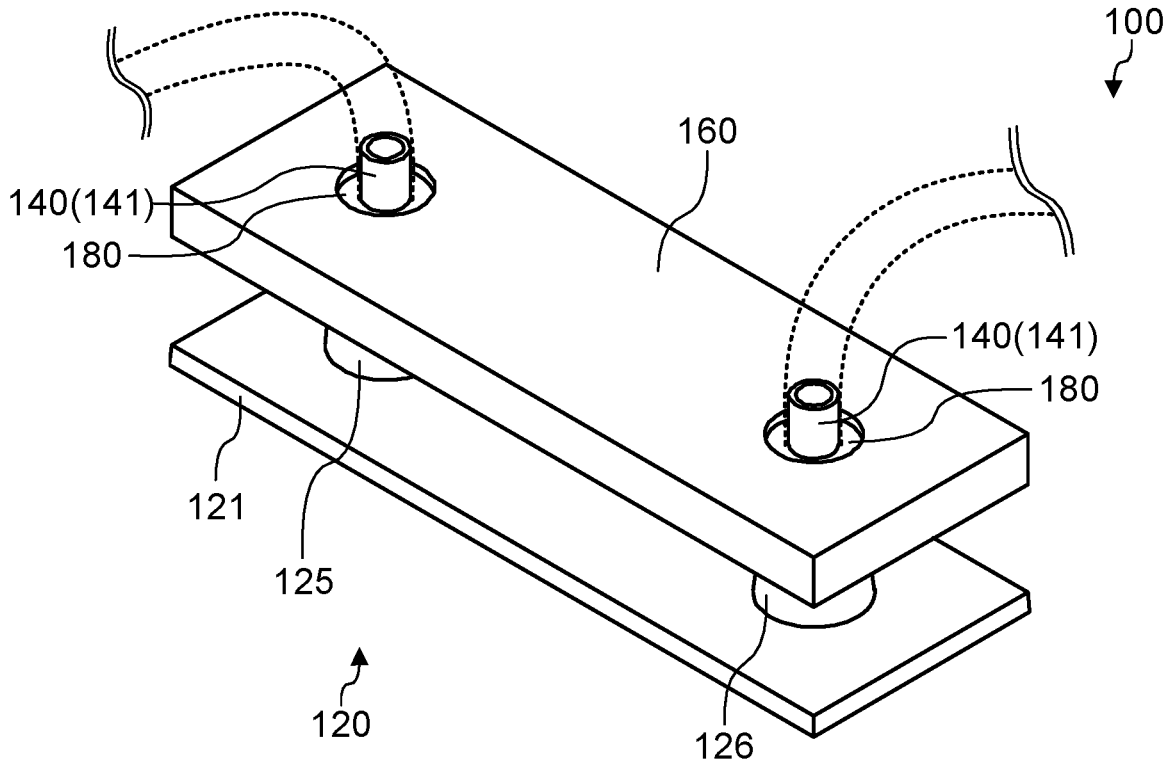
FIGS. 1A and 1B are perspective views illustrating a configuration of a fluid handling system according to embodiment 1 of the present invention.
Figure 1B:
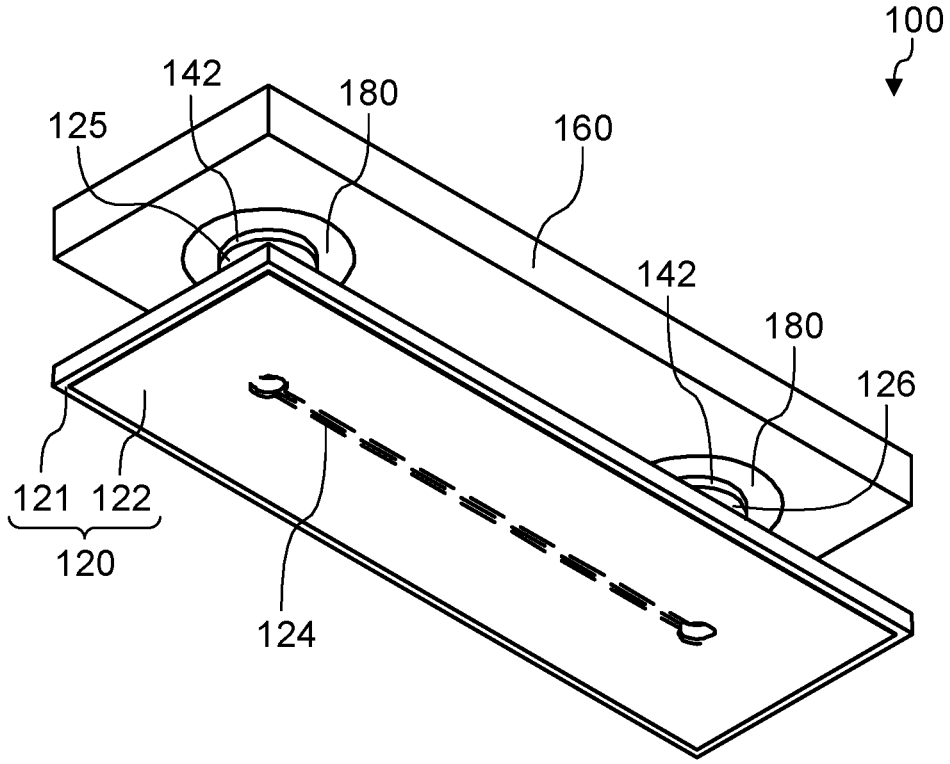
Figure 2A:
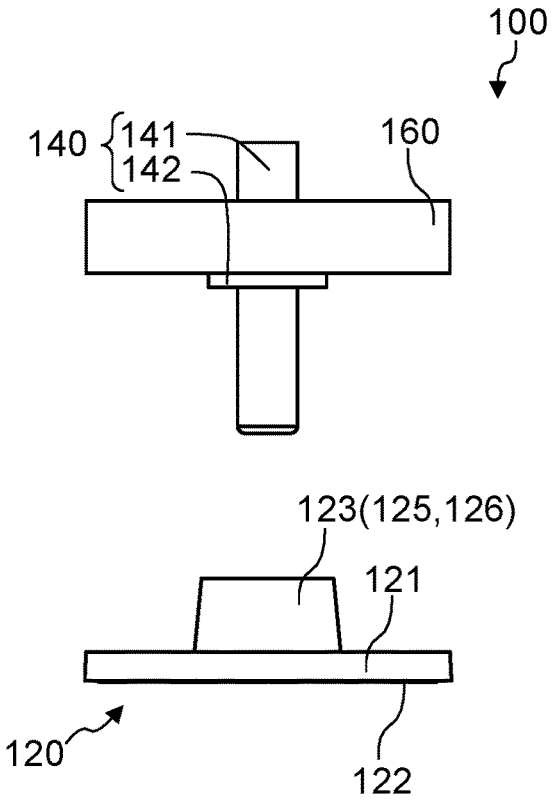
FIGS. 2A to 2D also illustrate the configuration of the fluid handling system according to embodiment 1 of the present invention.
Figure 2B:
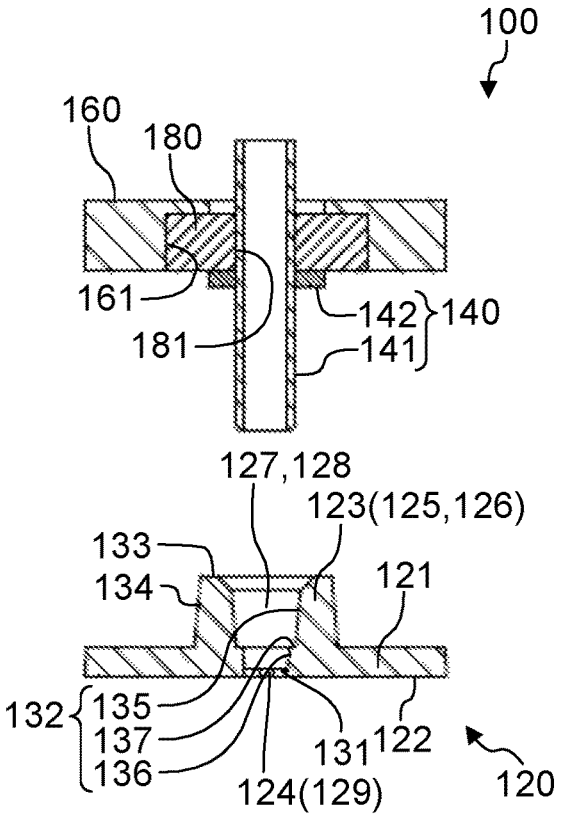
Figure 2C:
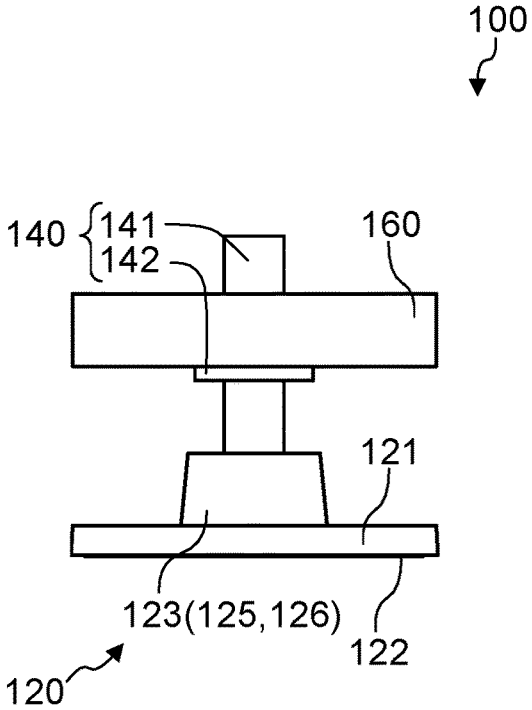
Figure 2D:
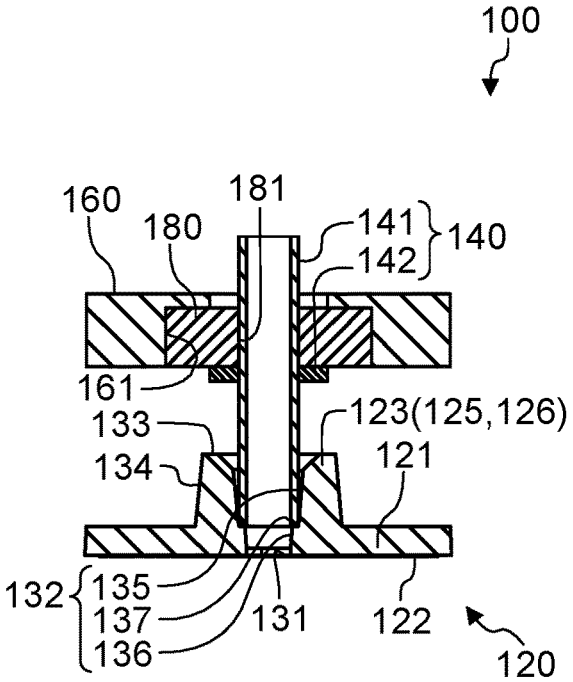

FIGS. 1A, 1B, and 2A to 2D illustrate fluid handling system 100 according to embodiment 1 of the present invention. FIG. 1A is a perspective view of fluid handling system 100 as viewed from the front side thereof. FIG. 1B is a perspective view of fluid handling system 100 as viewed from the back side thereof. FIG. 2A is a side view of fluid handling system 100 in a state before tube 140 is inserted into opening 123. FIG. 2B is a cross-sectional view of fluid handling system 100 in the state before tube 140 is inserted into opening 123. FIG. 2C is a side view of fluid handling system 100 in a state after tube 140 is inserted into opening 123. FIG. 2D is a cross-sectional view of fluid handling system 100 in the state after tube 140 is inserted into opening 123.

As illustrated in FIGS. 1A, 1B, and 2A to 2D, fluid handling system 100 includes fluid handling device 120, tube 140, support member 160 including first through hole 161, and first elastic member 180 including second through hole 181. (Herein, "a fluid handling system includes a tube" means "a fluid handling system includes at least one tube," and the same applies to, for example, "an elastic member," and "an opening.")

Fluid handling device 120 in the present embodiment is composed of substrate 121 and film 122. Film 122 is joined to one surface of substrate 121. The region surrounded by substrate 121 and film 122 serves as channel 124 for allowing a fluid to flow therethrough. Fluid handling device 120 includes channel 124 and opening 123. Opening 123 is introduction part 125 for introducing a fluid or discharge part 126 for discharging a fluid. In the present embodiment, fluid handling system 100 includes introduction part 125 and discharge part 126 as openings 123. A supply device (not shown) with tube 140 connected thereto is connected to introduction part 125 by support member 160 and first elastic member 180. In addition, a discharge device (not shown) with tube 140 connected thereto is connected to discharge part 126 by support member 160 and first elastic member 180. Examples of fluids flowing through channel 124 include reagents, liquid samples, gases, and powders.

Substrate 121 includes a channel groove and a plurality of through holes. In the present embodiment, substrate 121 includes a through hole on the introduction side (hereinafter also referred to as "introduction side through hole") 127, a through hole on the discharge side (hereinafter also referred to as "discharge side through hole") 128, and channel groove 129. Film 122 is joined to the surface where channel groove 129 is open. As film 122 joins to substrate 121, introduction side through hole 127 becomes introduction part 125, discharge side through hole 128 becomes discharge part 126, and channel groove 129 becomes channel 124. The numbers of channels 129 and the through holes may be any numbers that can be appropriately set.

Substrate 121 may have any thickness. The thickness of substrate 121 including introduction part 125 is, for example, 1 mm or more and 10 mm or less. Any material may be used for substrate 121, and can be appropriately selected from known resins and glass. Examples of the material for substrate 121 include polyethylene terephthalate, polycarbonate, polymethyl methacrylate, vinyl chloride, polypropylene, polyether, polyethylene, cycloolefin polymers, and cycloolefin copolymers.

Film 122 is joined to one surface of substrate 121. Any material may be used for film 122, and can be appropriately selected from known resins. Examples of the material for film 122 include polyethylene terephthalate, polycarbonate, polymethyl methacrylate, vinyl chloride, polypropylene, polyether, polyethylene, cycloolefin polymers, and cycloolefin copolymers. The thickness of film 122 is, for example, 30 μm or more and 300 μm or less. Film 122 is joined to substrate 121 by, for example, thermal compression bonding, laser welding, or an adhesive.

Introduction part 125 is a bottomed recess that is connected to channel 124 and is open to the outside. In the present embodiment, introduction part 125 has a shape of a bottomed cylinder. One end (upstream end) of channel 124 is open at the bottom portion of introduction part 125. Introduction part 125 is composed of introduction side through hole 127 of substrate 121 and a part of film 122 that closes one opening portion of introduction side through hole 127. Introduction part 125 may have any size that can be appropriately designed as needed. In the present embodiment, the inner diameter of the opening portion of introduction part 125 is about 2 mm.

In the present embodiment, introduction part 125 includes bottom surface 131, inner surface 132, top surface 133, and outer peripheral surface 134.

In the present embodiment, inner surface 132 includes first inner surface 135 on the opening portion side, second inner surface 136 on the bottom portion side, and step surface 137 connecting first inner surface 135 and second inner surface 136 with each other. Each of first inner surface 135 and second inner surface 136 is a tapered surface inclined in such a way that the distance of the surface from the center of introduction part 125 decreases from the opening portion toward the bottom portion. In other words, first inner surface 135 and second inner surface 136 each have the shape of the side surface of an inverted frustum. When viewed in plan view, the distance between first inner surface 135 and the center of introduction part 125 is longer than the distance between second inner surface 136 and the center of introduction part 125. First inner surface 135 holds the outer peripheral surface of tube body 141. Step surface 137 is a flat surface parallel to the surface of substrate 121, and connects the end of first inner surface 135 on the bottom portion side with the end of second inner surface 136 on the opening portion side. In the present embodiment, step surface 137 is formed so as to be located on the same plane as the surface of substrate 121. The surface at the end (hereinafter also referred to as "end surface") of tube body 141 comes into contact with step surface 137.

Top surface 133 is disposed so as to face first flange 142. In the present embodiment, top surface 133 includes a tapered inner surface.

In the present embodiment, outer peripheral surface 134 is a tapered surface inclined in such a way that the distance of the surface from the center of introduction part 125 increases from the opening portion toward the bottom portion. In other words, outer peripheral surface 134 has the shape of the side surface of a frustum.

Discharge part 126 is a bottomed recess that is connected to channel 124 and is open to the outside. In the present embodiment, discharge part 126 has a shape of a bottomed cylinder. One end (downstream end) of channel 124 is open at the bottom portion of discharge part 126. Discharge part 126 is composed of discharge side through hole 128 of substrate 121 and a part of film 122 that closes one opening portion of discharge side through hole 128. Discharge part 126 may have any size that can be appropriately designed as needed. In the present embodiment, the inner diameter of the opening portion of discharge part 126 is about 2 mm.

In the present embodiment, discharge part 126 includes bottom surface 131, inner surface 132, top surface 133, and outer peripheral surface 134.

In the present embodiment, inner surface 132 includes first inner surface 135 on the opening portion side, second inner surface 136 on the bottom portion side, and step surface 137 connecting first inner surface 135 and second inner surface 136 with each other. Each of first inner surface 135 and second inner surface 136 is a tapered surface inclined in such a way that the distance of the surface from the center of discharge part 126 decreases from the opening portion toward the bottom portion. In other words, first inner surface 135 and second inner surface 136 each have the shape of the side surface of an inverted frustum. When viewed in plan view, the distance between first inner surface 135 and the center of discharge part 126 is longer than the distance between second inner surface 136 and the center of discharge part 126. First inner surface 135 holds the outer peripheral surface of tube body 141. Step surface 137 is a flat surface parallel to the surface of substrate 121, and connects the end of first inner surface 135 on the bottom portion side with the end of second inner surface 136 on the opening portion side. In the present embodiment, step surface 137 is formed so as to be located on the same plane as the surface of substrate 121. The end surface of tube body 141 comes into contact with step surface 137.

Top surface 133 is disposed so as to face first flange 142. In the present embodiment, top surface 133 includes a tapered inner surface.

Channel 124 connects introduction part 125 and discharge part 126 to each other. One end (first end) of channel 124 is connected to introduction part 125, and the other end (second end) of channel 124 is connected to discharge part 126. Channel 124 is composed of channel groove 129 of substrate 121 and a part of film 122 that closes channel groove 129. Channel 124 may have any structure that allows a fluid to properly flow therethrough. The cross section of channel 124 orthogonal to the direction in which a fluid flows may have any shape such as a semicircular shape or a rectangular shape. The cross section of channel 124 may also have any size. The cross-sectional shape of channel 124 is, for example, a substantially rectangular shape having the length of one side (width and depth) of about several tens of micrometers. The cross-sectional area of channel 124 may or may not be constant in the flow direction of the fluid. In the present embodiment, the cross-sectional area of channel 124 is constant from the upstream end to the downstream end of channel 124.

As described above, tube 140, which is connected to supply device (not shown), is connected to introduction part 125 by support member 160 and first elastic member 180, and tube 140, which is connected to discharge device (not shown), is connected to discharge part 126 by support member 160 and first elastic member 180. Support member 160, first elastic member 180, and tube 140 connecting introduction part 125 with the introduction device are the same as support member 160, first elastic member 180, and tube 140 connecting discharge part 126 with the supply device. Accordingly, in the following, tube 140 connecting introduction part 125 with the introduction device, support member 160, and first elastic member 180 will be described.

One end (first end) of tube 140 is connected to introduction part 125, and the other end (second end) is connected to the introduction device for introducing a fluid. Tube 140 includes tube body 141 and first flange 142.

Tube body 141 may have any inner diameter that can be appropriately set. The outer diameter of tube body 141 is preferably set in such a way that tube body 141 comes into contact with first inner surface 135 when tube 140 is connected to introduction part 125. Tube body 141 is thus inserted into introduction part 125 by press fitting. In addition, the end surface of tube body 141 preferably comes into contact with step surface 137 when the end surface is placed in introduction part 125 (discharge part 126) by insertion. This configuration can prevent fluid leakage because the end surface and the side surface of tube body 141 come into contact with inner surface 132 of introduction part 125.

Tube body 141 and first flange 142 may be formed integrally or as separate bodies. In the present embodiment, tube body 141 and first flange 142 are formed as separate bodies. First flange 142 has a shape of a ring. First flange 142 may have any outer shape. The outer shape of first flange 142 may be circular or polygonal. In the present embodiment, the outer shape of first flange 142 is circular. The outer edge portion of first flange 142 in plan view is formed to be smaller than the opening portion of first through hole 161—the opening portion is located on the fluid handling device 120 side. This configuration allows first flange 142 to contact only first elastic member 180 without contacting support member 160, thus the angle of tube 140 with respect to first elastic member 180 can be changed at any value. In the present embodiment, tube body 141 is inserted into ring-shaped first flange 142, thereby fixing first flange 142 at a predetermined position on tube body 141. Tube 140 passes through first elastic member 180 via (in other words, by passing through) second through hole 181.

Support member 160 supports tube 140 via first elastic member 180. Support member 160 includes first through hole 161. In the present embodiment, first through hole 161 supports first elastic member 180 that holds tube 140. First through hole 161 may be in any shape that can exhibit the above functions. The shape of first through hole 161 in plan view may be circular or polygonal. In the present embodiment, first through hole 161 has a circular shape in plan view. First through hole 161 has a region, where the inner diameter of the first through hole is larger, on the fluid handling device 120 side and a region, where the inner diameter is smaller, on the side opposite to the fluid handling device 120 side. First elastic member 180 is disposed in the region on the fluid handling device 120 side where the inner diameter is larger.

Support member 160 may have any configuration that can support tube 140. The support member 160 may have a shape of a plate or a cylinder. In the present embodiment, support member 160 has a shape of a plate. In addition, support member 160 may be made of any material that can exhibit the above functions. Examples of the material for support member 160 include metals, resins, and hard rubber. Examples of the metals include stainless steel, aluminum, and steel. Examples of the resins include polyethylene terephthalate, polycarbonate, polymethyl methacrylate, vinyl chloride, polypropylene, polyether, polyethylene, cycloolefin polymers, and cycloolefin copolymers. The material of support member 160 is preferably harder than the material of first elastic member 180 described below. The material of support member 160 is preferably a metal such as aluminum from the viewpoint of workability and rigidity. In addition, support member 160 may be positioned with respect to fluid handling device 120.

First elastic member 180 is elastic. First elastic member 180 supports tube 140 so as to allow the movement of tube 140 (movably supports tube 140). First elastic member 180 comes into contact with first flange 142 and fluid handling device 120 or support member 160. In the present embodiment, first elastic member 180 comes into contact with first flange 142 and support member 160, but does not come into contact with introduction part 125 (fluid handling device 120). First elastic member 180 includes second through hole 181. Second through hole 181 is formed to have a size slightly larger than the outer diameter of tube body 141. Tube 140 is press fitted into second through hole 181 until first flange 142 comes into contact with first elastic member 180. As first elastic member 180, in which tube 140 is inserted into second through hole 181, is disposed in first through hole 161, tube 140 is supported by support member 160 (see FIGS. 2A and 2B). As first elastic member 180 holds tube 140, tube 140 can move slightly in the axial direction (vertical direction of the drawings in FIGS. 2A to 2D) of tube 140, the direction orthogonal to the axis (horizontal or planar direction of the drawings in FIGS. 2A to 2D), and the rotational direction about the axis. Tube 140 can also change the angle thereof with respect to fluid handling device 120.

Examples of first elastic member 180 include gaskets and sealing members. The shore hardness of the material of first elastic member 180 is preferably in the range of 10 to 90. A shore hardness of the material of first elastic member 180 within the above range allows tube body 141 to move suitably. Examples of the material of first elastic member 180 include silicone, elastomer, natural rubber, chloroprene rubber, nitrile rubber, butyl rubber, ethylene propylene rubber, urethane rubber, silicone rubber, and fluoro rubber.

Effects

Figure 3:
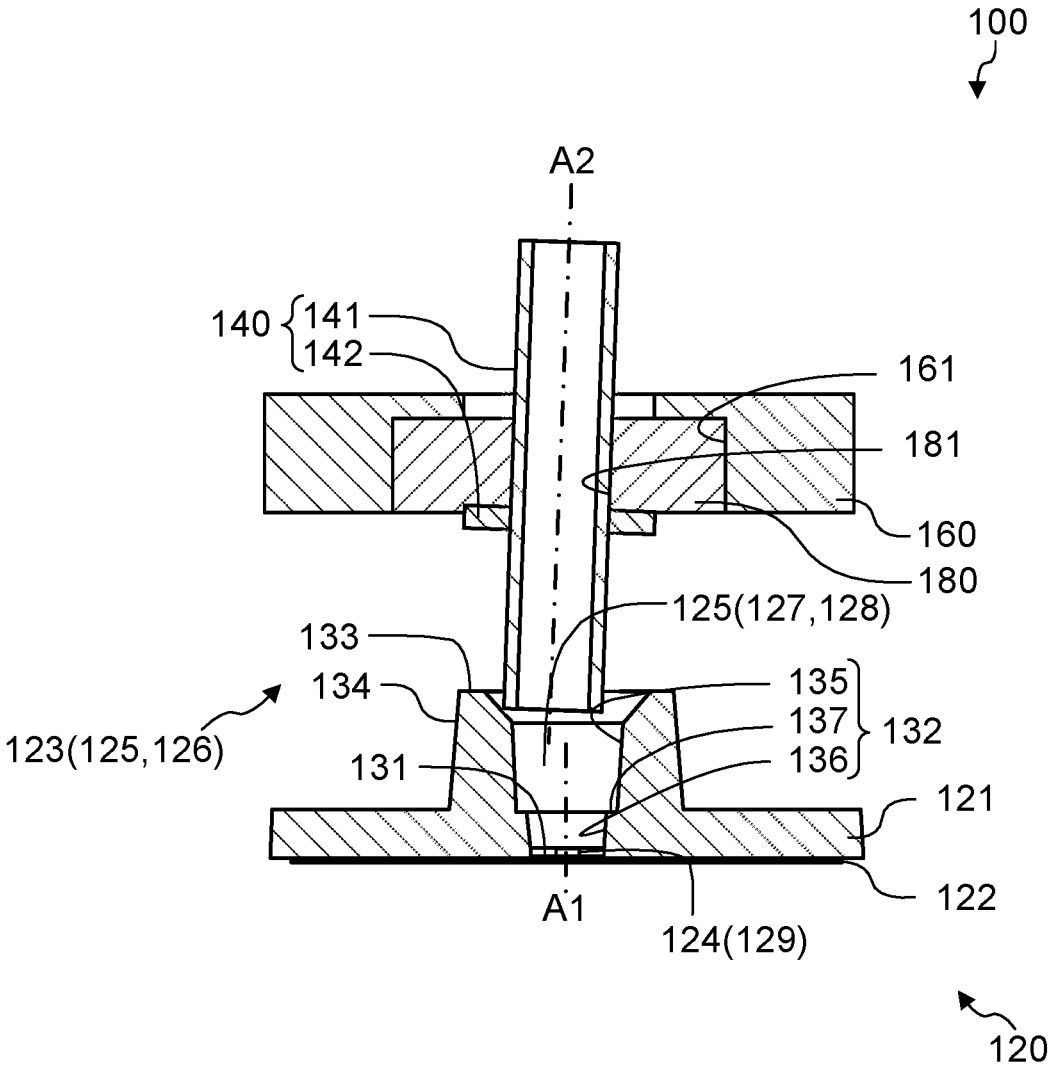
FIG. 3 is a cross-sectional view for explaining the effects of the fluid handling system according to embodiment 1.

FIG. 3 is a diagram for explaining the effects of the present invention. As illustrated in FIG. 3, the end of tube 140 is disposed immediately above opening 123 for connecting opening 123 (introduction part 125 or discharge part 126) with tube 140. Tube 140 is then inserted into opening 123, but axis A1 of opening 123 does not coincides with axis A2 of tube 140 in some cases. In other words, the axis of tube 140 may be at an angle with respect to the axis of opening 123. In fluid handling system 100 of the present embodiment, however, tube 140 is movable in the planar, vertical and rotational directions due to first elastic member 180, and the angle of tube 140 with respect to fluid handling device 120 can also be changed, thus tube 140 can be moved in such a way that axis A1 of opening 123 coincides with axis A2 of tube 140. The upper portion of introduction part 125 or discharge part 126 has a tapered structure, thus the tip of tube 140 can be readily inserted into introduction part 125 or discharge part 126. This configuration brings a part of the outer surface of tube body 141 into close contact with a part of inner surface 132 of opening 123. Tube 140 thus can be properly connected with opening 123 of fluid handling device 120. Therefore, fluid leakage can be prevented in fluid handling device 120 of the present embodiment. In addition, a plurality of tubes 140 can be simultaneously connected to fluid handling device 120.

Embodiment 2

Configuration of Fluid Handling System

In the following, fluid handling system 200 according to embodiment 2 will be described. Fluid handling system 200 according to the present embodiment is the same as fluid handling system 100 according to embodiment 1 except for the configurations of fluid handling device 220 and first flange 242. Therefore, the same components as those of fluid handling system 100 according to embodiment 1 are designated by the same reference numerals, and the description thereof will be omitted.

Figure 4A:
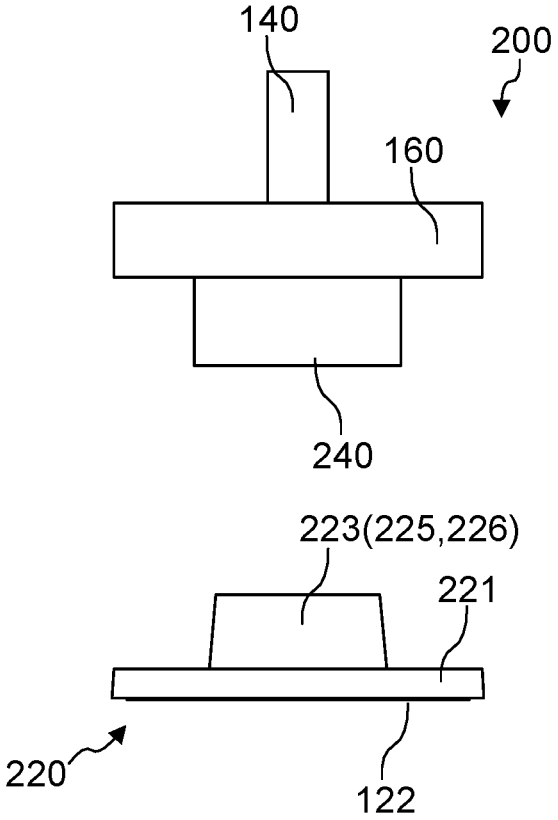
FIGS. 4A to 4D illustrate a configuration of a fluid handling system according to embodiment 2 of the present invention.
Figure 4B:
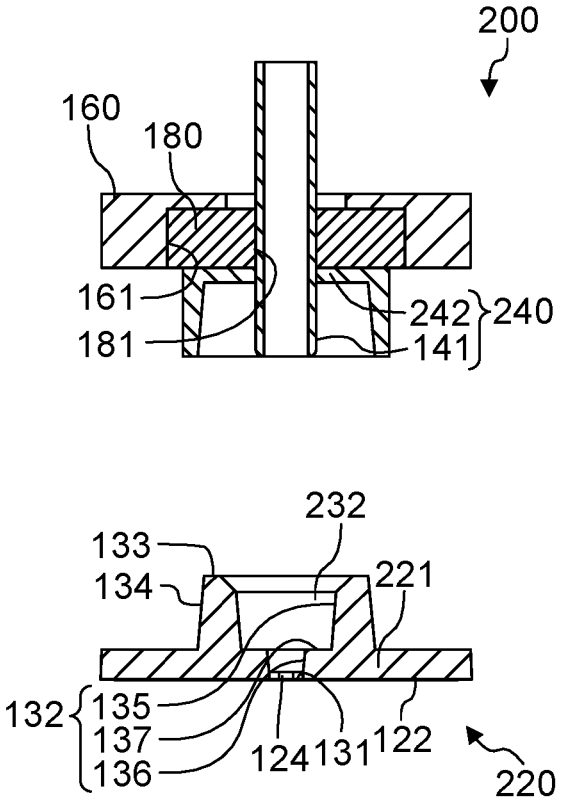
Figure 4C:
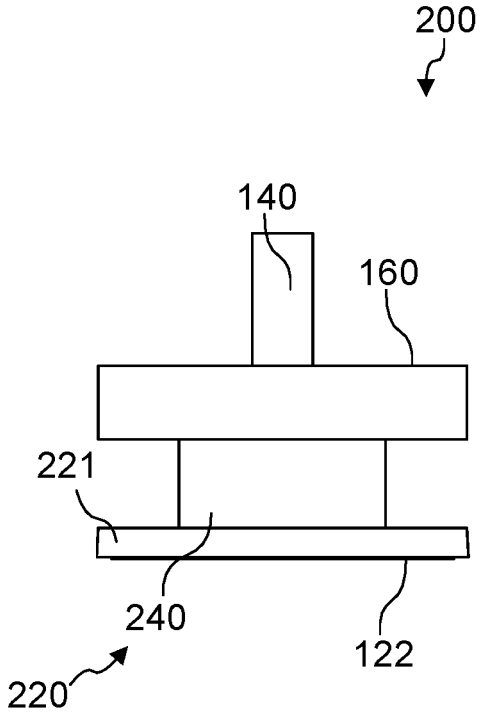
Figure 4D:
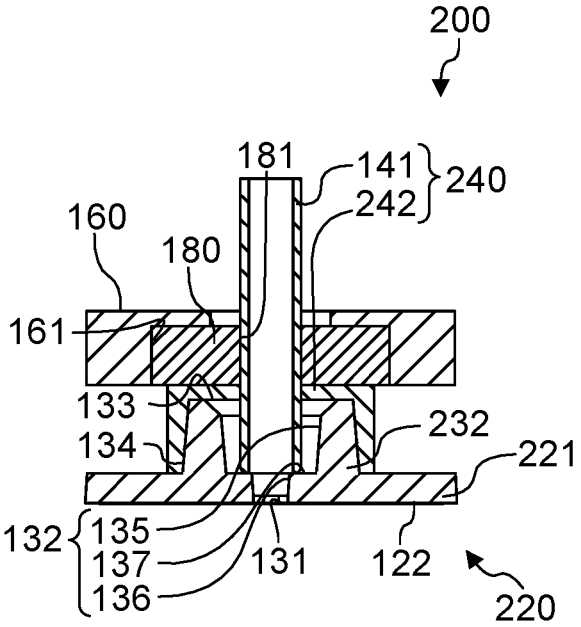

FIG. 4A is a side view of fluid handling system 200 in a state before tube 240 is inserted into opening 223. FIG. 4B is a cross-sectional view of fluid handling system 200 in the state before tube 240 is inserted into opening 223. FIG. 4C is a side view of fluid handling system 200 in a state after tube 240 is inserted into opening 223. FIG. 4D is a cross-sectional view of fluid handling system 200 in the state after tube 240 is inserted into opening 223.

As illustrated in FIGS. 4A to 4D, fluid handling system 200 includes fluid handling device 220, tube 240, support member 160, and first elastic member 180.

Fluid handling device 220 of the present embodiment is composed of substrate 221 and film 122, and includes channel 124 and at least one opening 223 including introduction part 225 and discharge part 226. Introduction part 225 of the present embodiment is formed larger than introduction part 125 of embodiment 1 in the direction along the surface of substrate 221. In addition, discharge part 226 of the present embodiment is formed larger than discharge part 126 of embodiment 1 in the direction along the surface of substrate 221.

In the present embodiment, tube 240 includes tube body 141 and first flange 242.

In the present embodiment, first flange 242 has a shape of a bottomed cylinder with a through hole at the bottom portion thereof. The inner surface of first flange 242 preferably has a shape complementary to outer peripheral surface 134 of introduction part 225. In other words, the inner surface of first flange 242 has a shape of the side surface of a truncated cone.

As described above, opening 223 is formed larger than that of embodiment 1 in the direction along the surface of substrate 221 in the present embodiment. In addition, the shape of the inner surface 242 of first flange is complementary to the shape of outer peripheral surface 134 of opening 223. When tube 240 is inserted into opening 223 for connecting tube 240 with opening 223, the above configuration allows inner surface of first flange 242 to come into contact with outer peripheral surface 134 of opening 223, and the top surface of first flange 242 to come into contact with the surface of substrate 221. The end surface of tube body 141 comes into contact with step surface 137. When opening 223 in fluid handling device 220 is connected with tube 240 in the present embodiment, fluid leakage can be prevented because tube 240 is movable in the planar, vertical and rotational directions due to first elastic member 180, and thus tube 240 can be moved in such a way that axis A1 of opening 223 coincides with axis A2 of tube 240, bringing tube 240 into close contact with opening 223.

Effects

As described above, fluid handling system 200 according to the present embodiment has the same effects as fluid handling system 100 according to embodiment 1. As first flange 242 comes into close contact with opening 223 in fluid handling system 200 according to the present embodiment, fluid leakage can be further prevented as compared with embodiment 1.

Embodiment 3

Configuration of Fluid Handling System

In the following, fluid handling system 300 according to embodiment 3 will be described. Fluid handling system 300 according to the present embodiment is the same as fluid handling system 100 according to embodiment 1 except that fluid handling system 300 includes second elastic member 382. Therefore, the same components as those of fluid handling system 100 according to embodiment 1 are designated by the same reference numerals, and the description thereof will be omitted.

Figure 5A:
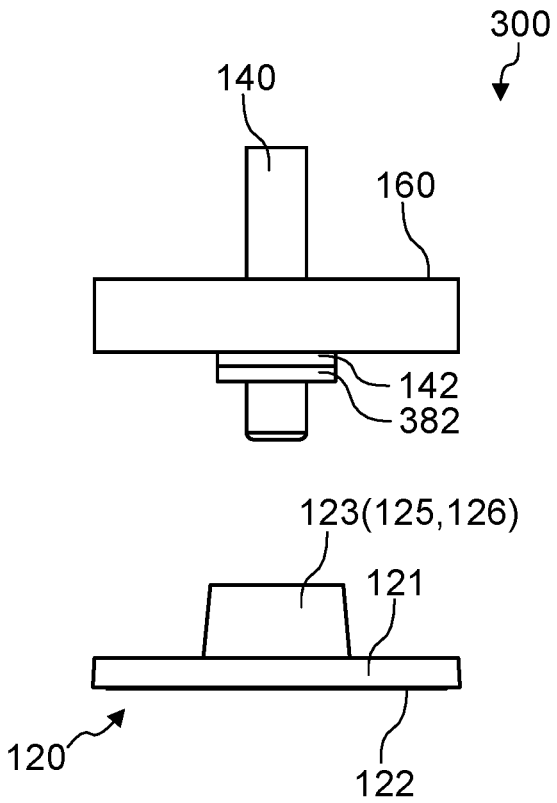
FIGS. 5A to 5D illustrate a configuration of a fluid handling system according to embodiment 3 of the present invention.
Figure 5B:
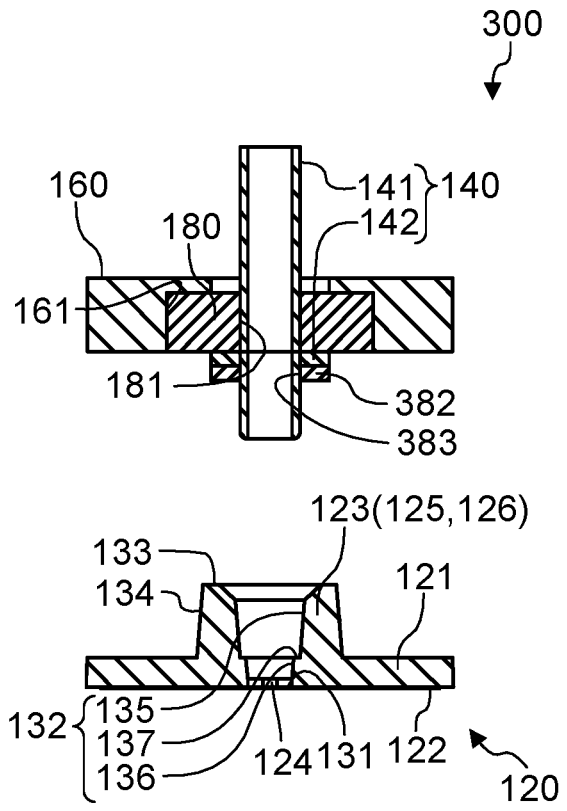
Figure 5C:
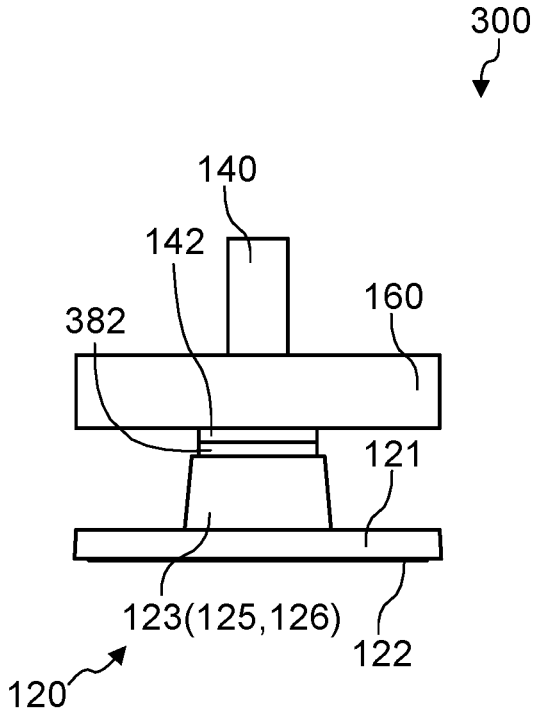
Figure 5D:
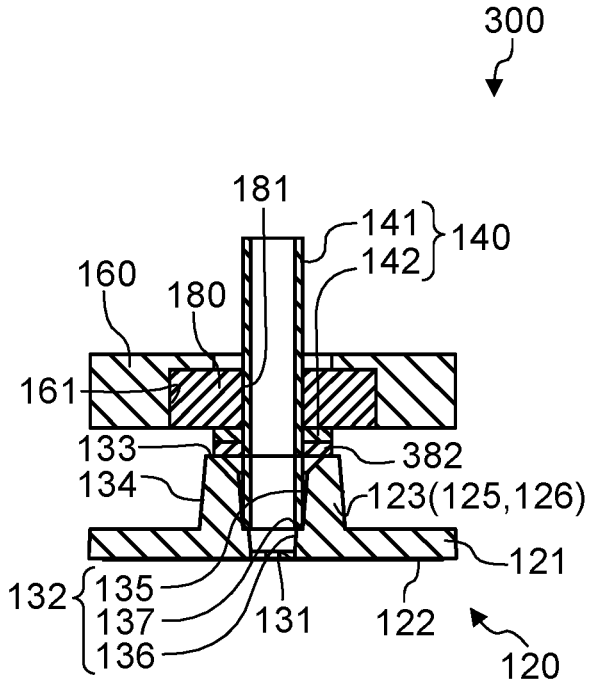

FIG. 5A is a side view of fluid handling system 300 in a state before tube 140 is inserted into opening 123 FIG. 5B is a cross-sectional view of fluid handling system 300 in the state before tube 140 is inserted into opening 123. FIG. 5C is a side view of fluid handling system 300 in a state after tube 140 is inserted into opening 123. FIG. 5D is a cross-sectional view of fluid handling system 300 in the state after tube 140 is inserted into opening 123.

As illustrated in FIGS. 5A to 5D, fluid handling system 300 includes fluid handling device 120, tube 140, support member 160, first elastic member 180, and second elastic member 382.

Second elastic member 382 of the present embodiment is disposed between first flange 142 and fluid handling device 120. Second elastic member 382 comes into contact with first flange 142 and fluid handling device 120, but does not come into contact with support member 160. In the present embodiment, second elastic member 382 is elastic. Second elastic member 382 is made of rubber and includes third through hole 383. Third through hole 383 is slightly smaller than the cross section of tube 140 orthogonal to the direction in which a fluid flows. In addition, second elastic member 382 has a size capable of covering the opening portion of introduction part 125 or discharge part 126. Tube 140 is press fitted into third through hole 383 until second elastic member 382 comes into contact with first flange 142.

When tube 140 is inserted into opening 123 in fluid handling device 120 for connecting tube 140 with opening 123 in this configuration, the outer surface of tube body 141 and the inner surface of opening 123 partially come into contact with each other, and the end surface of tube body 141 comes into contact with step surface 137. In addition, first flange 142 comes into close contact with second elastic member 382, and second elastic member 382 comes into close contact with top surface 133 of opening 123. When opening 123 in fluid handling device 120 is connected with tube 140 in the present embodiment, fluid leakage can be prevented because tube 140 is movable in the planar, vertical and rotational directions due to first elastic member 180, and the angle of tube 140 with respect to fluid handling device 120 can also be changed, thus tube 140 can be moved in such a way that axis A1 of opening 123 coincides with axis A2 of tube 140, bringing tube 140 into close contact with opening 123.

Effects

As fluid handling system 300 according to the present embodiment includes second elastic member 382, first flange 142 comes into close contact with top surface 133 of opening 123 via second elastic member 382, thus fluid leakage can be further prevented as compared with embodiment 1.

Embodiment 4

Configuration of Fluid Handling System

In the following, fluid handling system 400 according to embodiment 4 will be described. Fluid handling system 400 according to the present embodiment is the same as fluid handling system 100 according to embodiment 1 except that fluid handling system 400 includes third elastic member 482. Therefore, the same components as those of fluid handling system 100 according to embodiment 1 are designated by the same reference numerals, and the description thereof will be omitted.

Figure 6A:
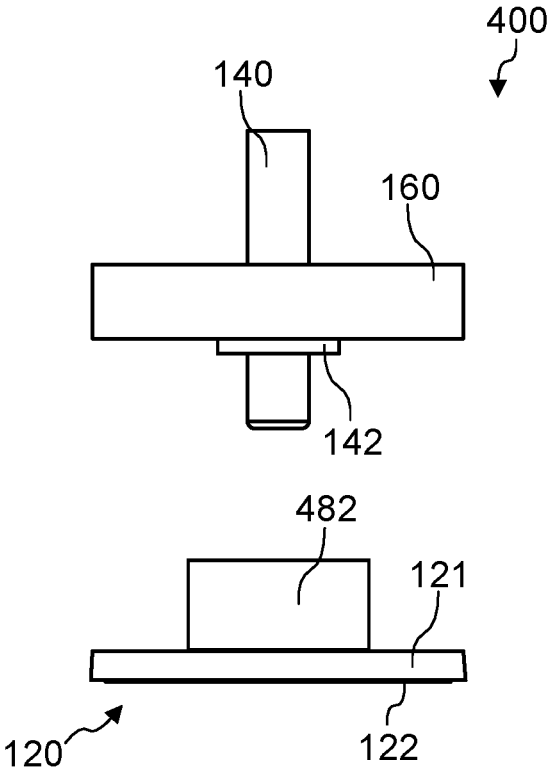
FIGS. 6A to 6D illustrate a configuration of a fluid handling system according to embodiment 4 of the present invention.
Figure 6B:
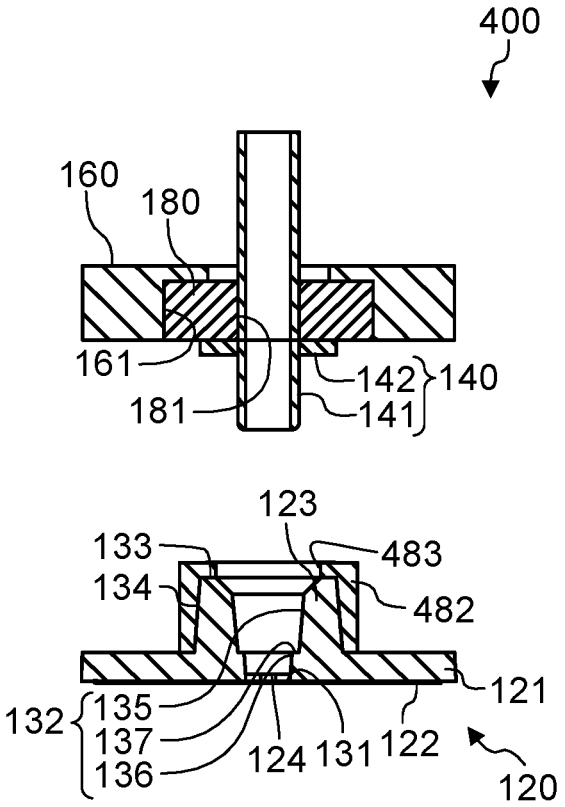
Figure 6C:
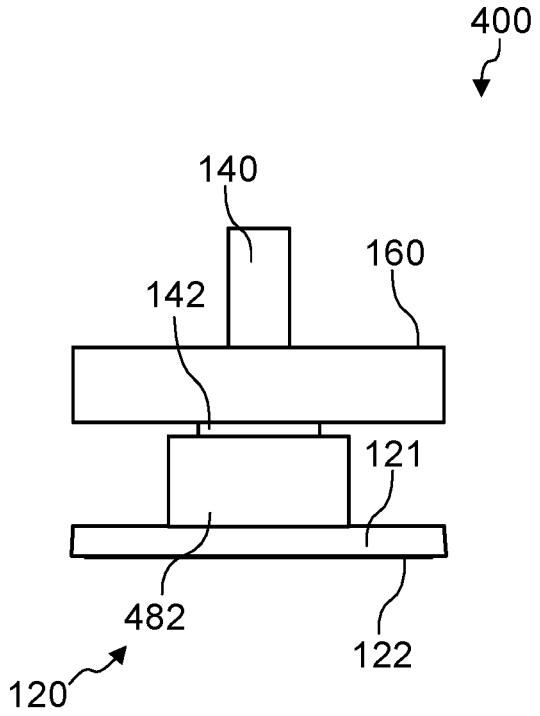
Figure 6D:
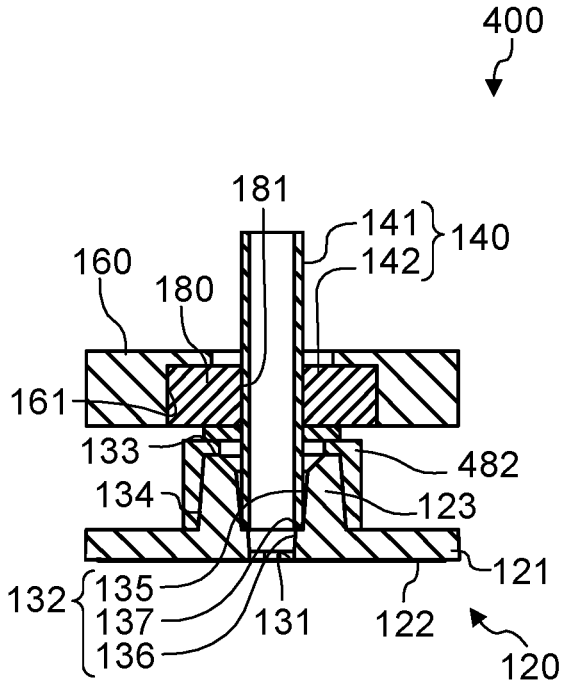

FIG. 6A is a side view of fluid handling system 400 in a state before tube 140 is inserted into opening 123 FIG. 6B is a cross-sectional view of fluid handling system 400 in the state before tube 140 is inserted into opening 123. FIG. 6C is a side view of fluid handling system 400 in a state after tube 140 is inserted into opening 123. FIG. 6D is a cross-sectional view of fluid handling system 400 in the state after tube 140 is inserted into opening 123.

As illustrated in FIGS. 6A to 6D, fluid handling system 400 includes fluid handling device 120, tube 140, support member 160, first elastic member 180, and third elastic member 482.

In the present embodiment, third elastic member 482 has a shape of a bottomed cylinder with fourth through hole 483 at the bottom portion thereof. Third elastic member 482 is disposed so as to come into contact with outer peripheral surface 134 and top surface 133 of opening 123 (introduction part 125 or discharge part 126). The inner surface of third elastic member 482 is preferably has a shape complementary to outer peripheral surface 134 of opening 123. In other words, the inner surface of third elastic member 482 has a shape of the side surface of a truncated cone. In the present embodiment, third elastic member 482 is elastic. In the present embodiment, third elastic member 482 is made of rubber.

When tube 140 is inserted into opening 123 in fluid handling device 120 for connecting tube 140 with opening 123 in this configuration, the outer peripheral surface of tube body 141 and the inner surface of opening 123 partially come into contact with each other, and the end surface of tube body 141 comes into contact with step surface 137. In addition, third elastic member 482 is in contact with opening 123, and third elastic member 482 comes into contact with first flange 142. When opening 123 is connected with tube 140 in the present embodiment, fluid leakage can be prevented because tube 140 is movable in the planar, vertical and rotational directions due to first elastic member 180, and the angle of tube 140 with respect to fluid handling device 120 can also be changed, thus tube 140 can be moved in such a way that axis A1 of opening 123 coincides with axis A2 of tube 140.

Effects

As described above, fluid handling system 400 according to the present embodiment has the same effects as fluid handling system 100 according to embodiment 1. As first flange 142 comes into close contact with third elastic member 482, and third elastic member 482 comes into close contact with introduction part 125 or discharge part 126 in fluid handling system 400 according to the present embodiment, fluid leakage can be further prevented as compared with embodiment 1.

Embodiment 5

Configuration of Fluid Handling System

In the following, fluid handling system 500 according to embodiment 5 will be described. Fluid handling system 500 according to the present embodiment is the same as fluid handling system 400 according to embodiment 4 except for the configurations of opening 223 and third elastic member 582. Therefore, the same components as those of fluid handling system 400 according to embodiment 4 are designated by the same reference numerals, and the description thereof will be omitted.

Figure 7A:
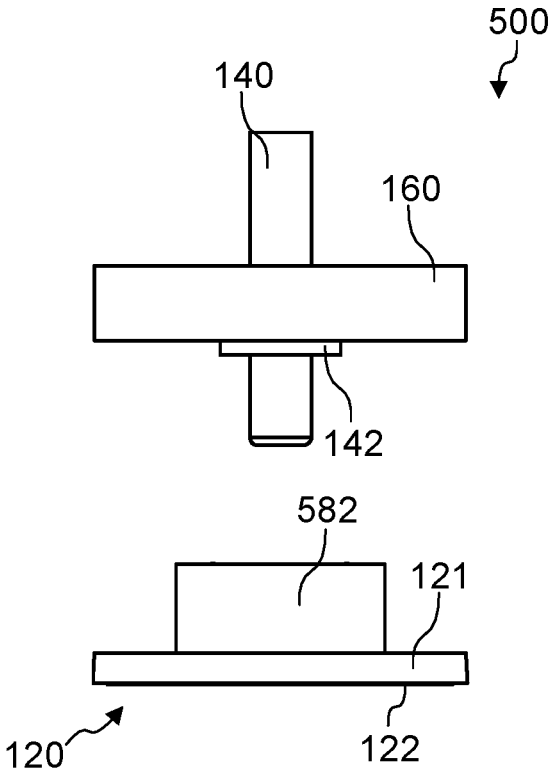
FIGS. 7A to 7D illustrate a configuration of a fluid handling system according to embodiment 5 of the present invention.
Figure 7B:
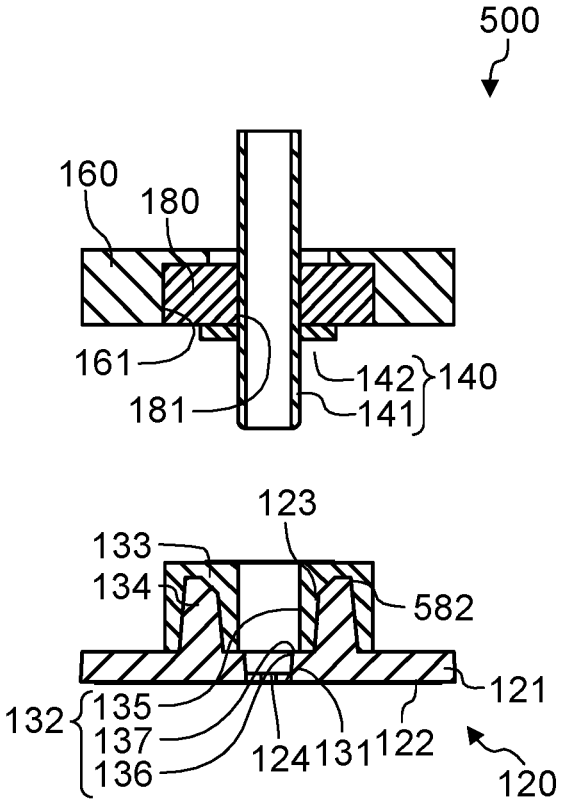
Figure 7C:
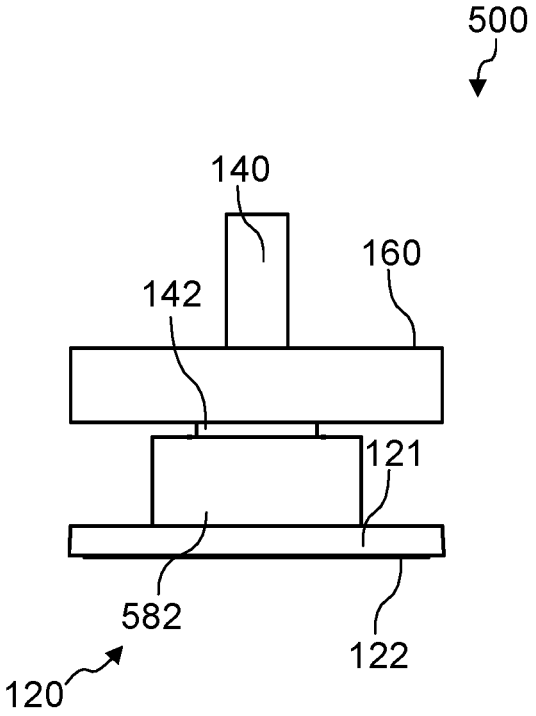
Figure 7D:
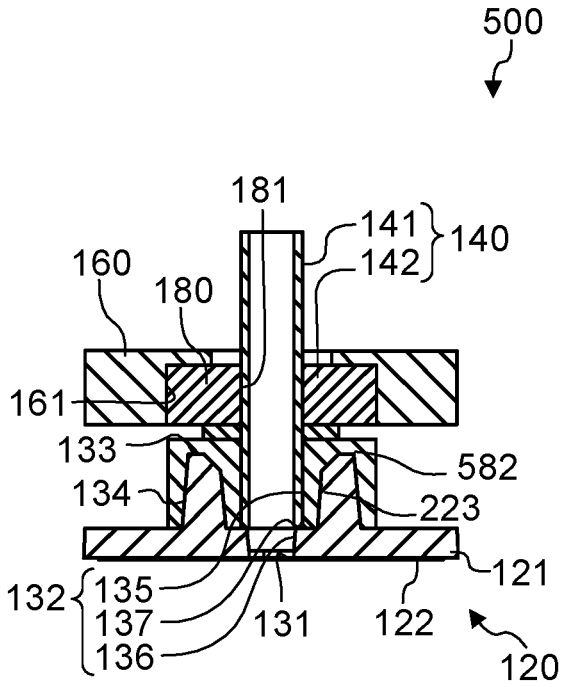

FIG. 7A is a side view of fluid handling system 500 in a state before tube 140 is inserted into opening 223. FIG. 7B is a cross-sectional view of fluid handling system 500 in the state before tube 140 is inserted into opening 223. FIG. 7C is a side view of fluid handling system 500 in a state after tube 140 is inserted into opening 223. FIG. 7D is a cross-sectional view of fluid handling system 500 in the state after tube 140 is inserted into opening 223.

As illustrated in FIGS. 7A to 7D, fluid handling system 500 includes fluid handling device 120, tube 140, support member 160, first elastic member 180, and third elastic member 582.

Opening 223 in the present embodiment is the same as opening 223 in embodiment 2.

Third elastic member 582 is formed so as to cover not only outer peripheral surface 134 and top surface 133 of opening 223 (introduction part 125 or discharge part 126)

but also first inner surface 135. In the present embodiment, third elastic member 582 is made of rubber.

When tube 140 is inserted into opening 223 in fluid handling device 120 for connecting tube 140 with opening 223 in this configuration, the end surface of tube body 141 comes into contact with step surface 137. In addition, third elastic member 582 is in contact with opening 223, and third elastic member 582 comes into contact with first flange 142. Further, the outer surface of tube body 141 comes into contact with third elastic member 582. When opening 223 is connected with tube 140, fluid leakage can be prevented because tube 140 is movable in the planar, vertical and rotational directions due to first elastic member 180, and thus tube 140 can be moved in such a way that axis A1 of opening 223 coincides with axis A2 of tube 140.

Effects

As described above, fluid handling system 500 according to the present embodiment has the same effects as fluid handling system 400 according to embodiment 4. In addition, as first flange 142 comes into close contact with third elastic member 582, third elastic member 582 comes into close contact with opening 123, and tube body 141 comes into close contact with third elastic member 582 in fluid handling system 500 according to the present embodiment, fluid leakage can be further prevented as compared with embodiment 4.

Embodiment 6

Configuration of Fluid Handling System

In the following, fluid handling system 600 according to embodiment 6 will be described. Fluid handling system 600 according to the present embodiment is the same as fluid handling system 400 according to embodiment 4 except for the configuration of third elastic member 682. Therefore, the same components as those of fluid handling system 400 according to embodiment 4 are designated by the same reference numerals, and the description thereof will be omitted.

Figure 8A:
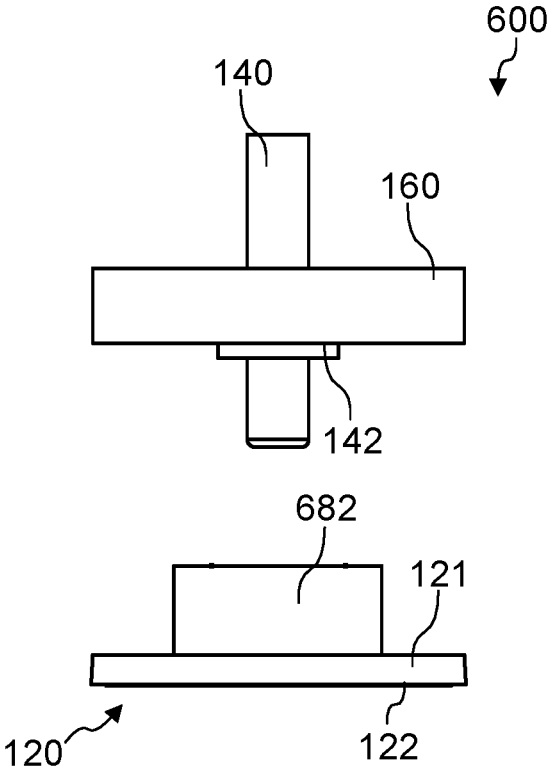
FIGS. 8A to 8D illustrate a configuration of a fluid handling system according to embodiment 6 of the present invention.
Figure 8B:
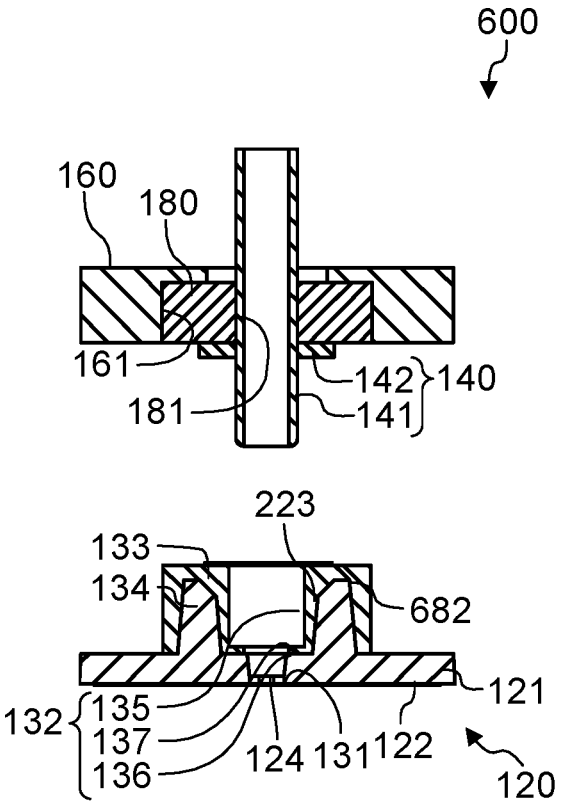
Figure 8C:
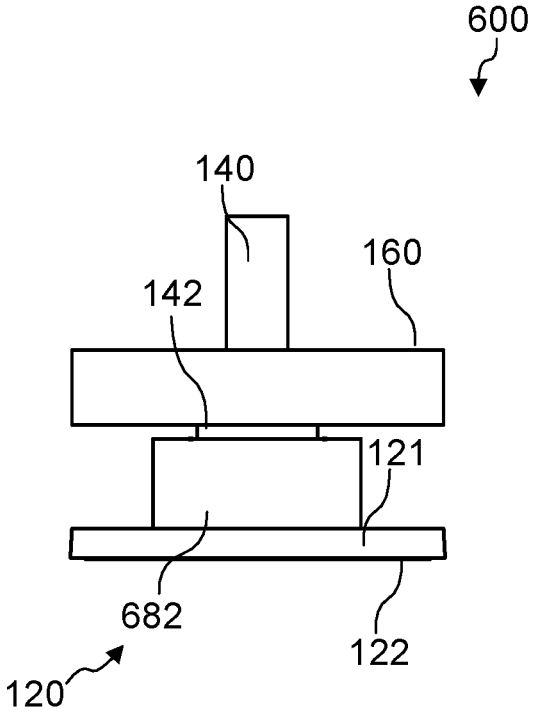
Figure 8D:
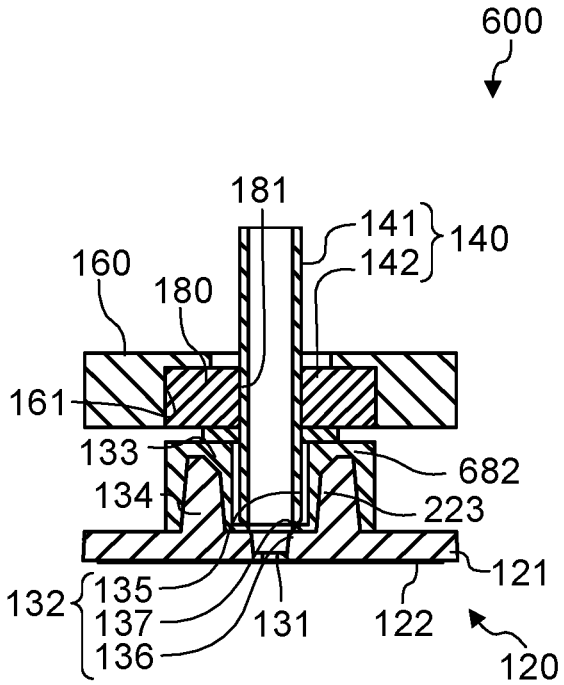

FIG. 8A is a side view of fluid handling system 600 in a state before tube 140 is inserted into opening 223. FIG. 8B is a cross-sectional view of fluid handling system 600 in the state before tube 140 is inserted into opening 223. FIG. 8C is a side view of fluid handling system 600 in a state after tube 140 is inserted into opening 223. FIG. 8D is a cross-sectional view of fluid handling system 600 in the state after tube 140 is inserted into opening 223.

As illustrated in FIGS. 8A to 8D, fluid handling system 600 includes fluid handling device 120, tube 140, support member 160, first elastic member 180, and third elastic member 682.

Third elastic member 682 in the present embodiment is disposed so as to cover not only outer peripheral surface 134 and top surface 133 of opening 223 (introduction part 125 or discharge part 126) but also first inner surface 135 and step surface 137. In the present embodiment, third elastic member 682 is made of rubber.

For connecting tube 140 with opening 223 in this configuration, the outer end surface of tube body 141 comes into contact with third elastic member 682. In addition, third elastic member 682 is in contact with opening 223, and third elastic member 682 comes into contact with first flange 142. Further, the outer surface of tube body 141 comes into contact with third elastic member 682. When opening 223 is connected with tube 140, fluid leakage can be prevented because tube 140 is movable in the planar, vertical and rotational directions due to first elastic member 180, and the angle of tube 140 with respect to fluid handling device 120 can also be changed, thus tube 140 can be moved in such a way that axis A1 of opening 223 coincides with axis A2 of tube 140.

Effects

As described above, fluid handling system 600 according to the present embodiment has the same effects as fluid handling system 400 according to embodiment 4. In addition, as first flange 142 comes into close contact with third elastic member 682, third elastic member 682 comes into close contact with opening 223, and tube body 141 comes into close contact with third elastic member 682 in fluid handling system 600 according to the present embodiment, fluid leakage can be further prevented as compared with embodiment 4.

Embodiment 7

Configuration of Fluid Handling System

In the following, fluid handling system 700 according to embodiment 7 will be described. Fluid handling system 700 according to the present embodiment is the same as fluid handling system 100 according to embodiment 1 except for the configuration of opening 723, the disposed location of first flange 142 on tube 140, and presence of fourth elastic member 782. Therefore, the same components as those of fluid handling system 100 according to embodiment 1 are designated by the same reference numerals, and the description thereof will be omitted.

Figure 9A:
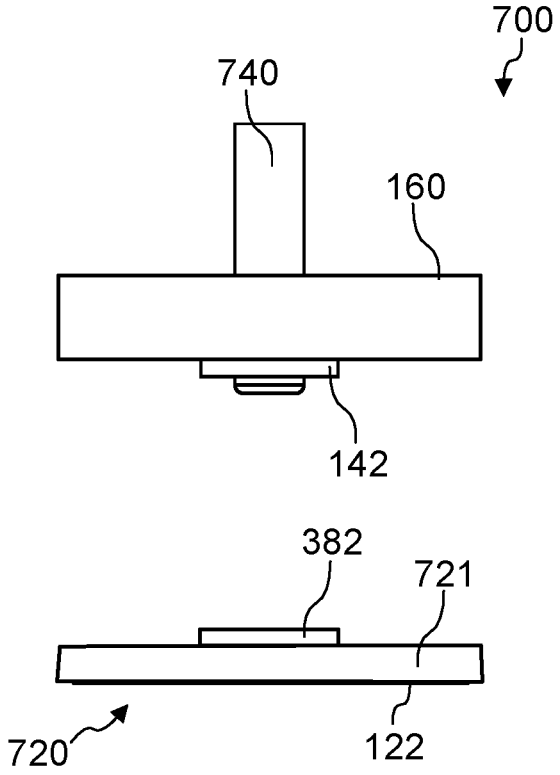
FIGS. 9A to 9D illustrate a configuration of a fluid handling system according to embodiment 7 of the present invention.
Figure 9B:
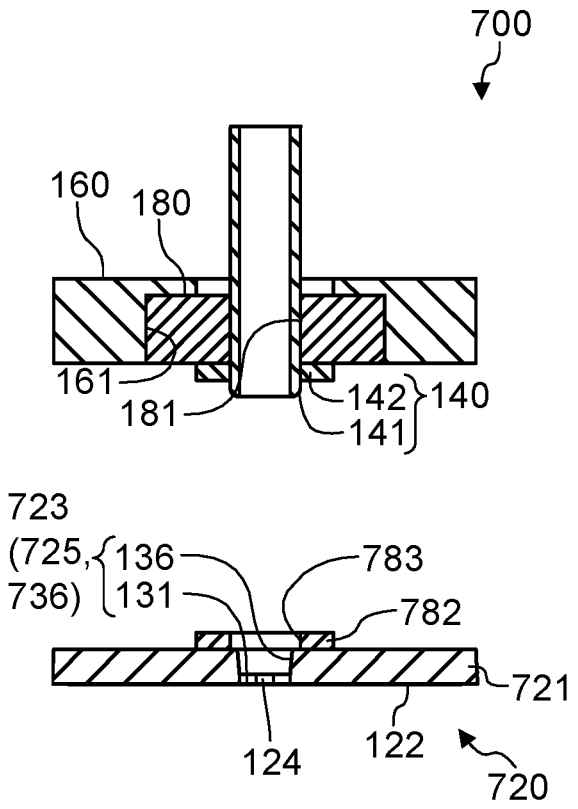
Figure 9C:
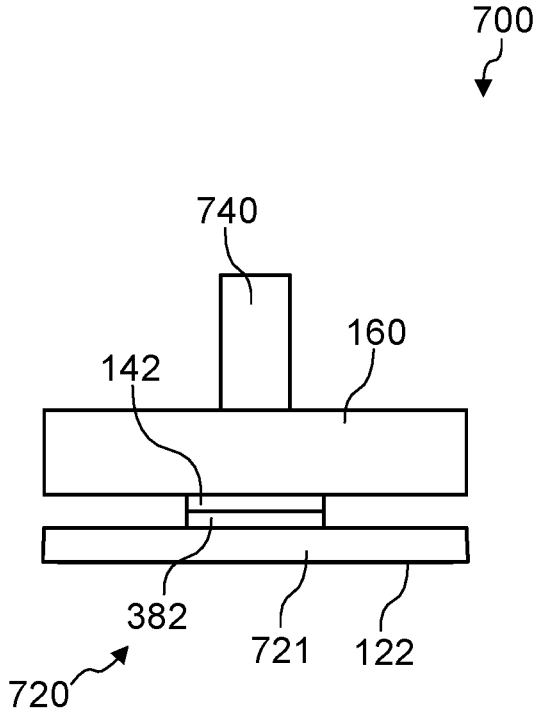
Figure 9D:
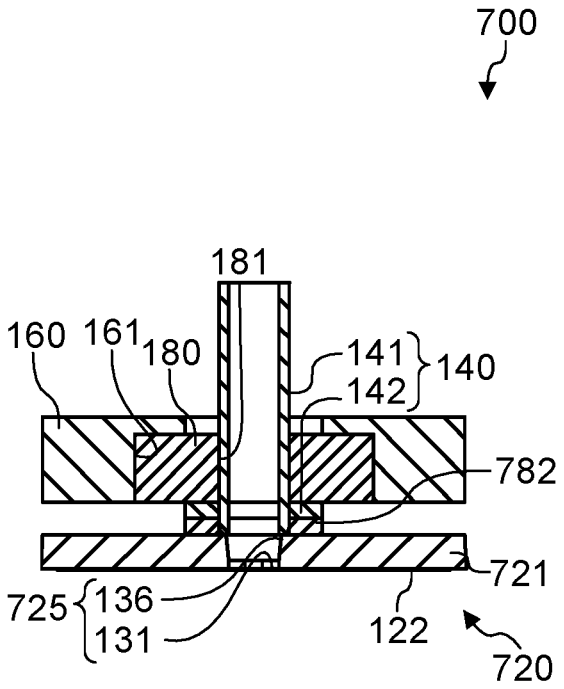

FIG. 9A is a side view of fluid handling system 700 in a state before tube 140 is inserted into opening 723. FIG. 9B is a cross-sectional view of fluid handling system 700 in the state before tube 140 is inserted into opening 723. FIG. 9C is a side view of fluid handling system 700 in a state after tube 140 is inserted into opening 723. FIG. 9D is a cross-sectional view of fluid handling system 700 in the state after tube 140 is inserted into opening 723.

As illustrated in FIGS. 9A to 9D, fluid handling system 700 includes fluid handling device 720, tube 140, support member 160, first elastic member 180, and fourth elastic member 782.

Fluid handling device 720 according to the present embodiment is composed of substrate 721 and film 122, and includes channel 124 and at least one opening 723. The at least one opening 723 includes introduction part 725 and discharge part 726. As introduction part 725 and discharge part 726 have the same structure, only introduction part 725 will be described.

Introduction part 725 in the present embodiment does not have first inner surface 135, step surface 137, top surface 133, or outer peripheral surface 134 as compared with introduction part 125 in embodiment 1. In other words, introduction part 725 in the present embodiment includes bottom surface 131 and second inner surface 136. This configuration facilitates production of substrate 721.

The length of first flange 142 and the length between the two ends of tube body 741 of tube 740 are the same as the length of fourth elastic member 782.

Fourth elastic member 782 is fixed to substrate 721. Fourth member 782 comes into contact with first flange 142, but does not come into contact with support member 160. Fourth elastic member 782 is elastic. In the present embodiment, fourth elastic member 782 is made of rubber and includes fourth through hole 783. Fourth through hole 783 is slightly smaller than the cross section of tube 140 orthogonal to the direction in which a fluid flows. In addition, fourth elastic member 782 has a size capable of covering the opening portion of opening 723. Tube 140 is press fitted into fourth through hole 783 until first flange 142 comes into contact with first elastic member 180.

When tube 140 is inserted into fourth elastic member 782 in fluid handling device 720 for connecting tube 140 with opening 723 in this configuration, the outer peripheral surface of tube body 141 comes into contact with fourth through hole 783 of fourth elastic member 782, and the end surface of tube body 141 comes into contact with the surface of substrate 721. In addition, first flange 142 comes into close contact with fourth elastic member 782, and fourth elastic member 782 comes into close contact with opening 723. When opening 723 in fluid handling device 720 is connected with tube 740, fluid leakage can be prevented because tube 740 is movable in the planar, vertical and rotational directions due to first elastic member 180, and thus tube 740 can be moved in such a way that axis A1 of opening 723 coincides with axis A2 of tube 740.

Effects

As described above, fluid handling system 700 according to the present embodiment has the same effects as fluid handling system 100 according to embodiment 1. In addition, fluid leakage can be prevented in fluid handling system 700 according to the embodiment because first flange 142 and fourth elastic member 782 come into close contact with each other. Even fluid handling system 700 according to the present embodiment does not have a cylindrical shape (chimney shape)—which is present in other embodiments—protruding from the surface of substrate 721, fourth elastic member 782 is fixed to the surface of substrate 721, and thus fluid leakage can be prevented by only press fitting tube 140 into fourth elastic member 782.

Embodiment 8

Configuration of Fluid Handling System

In the following, fluid handling system 800 according to embodiment 8 will be described.

Figure 10A:
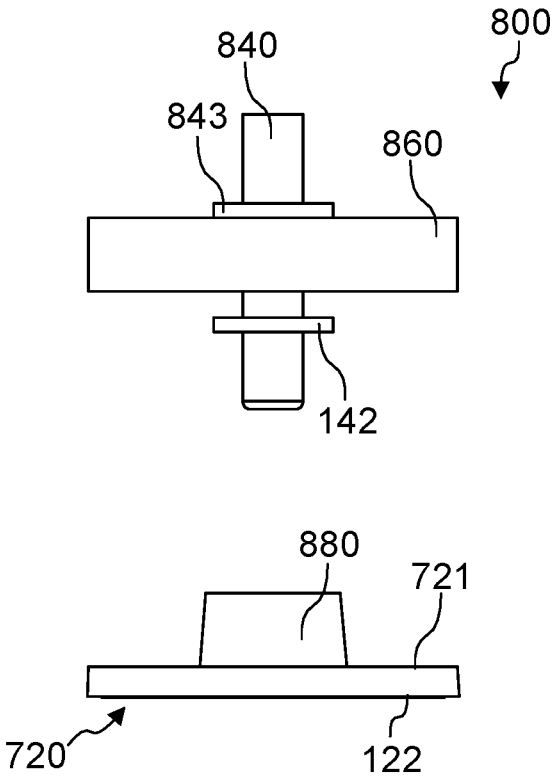
FIGS. 10A to 10D illustrate a configuration of a fluid handling system according to embodiment 8 of the present invention.
Figure 10B:
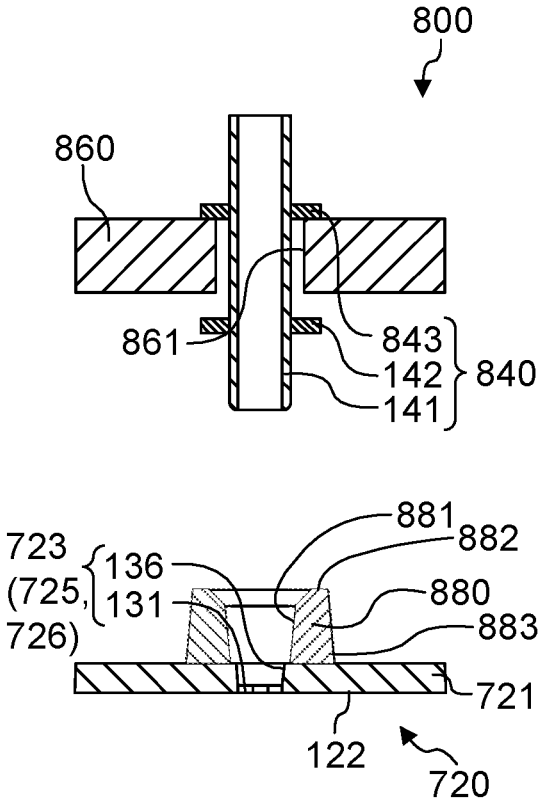
Figure 10C:
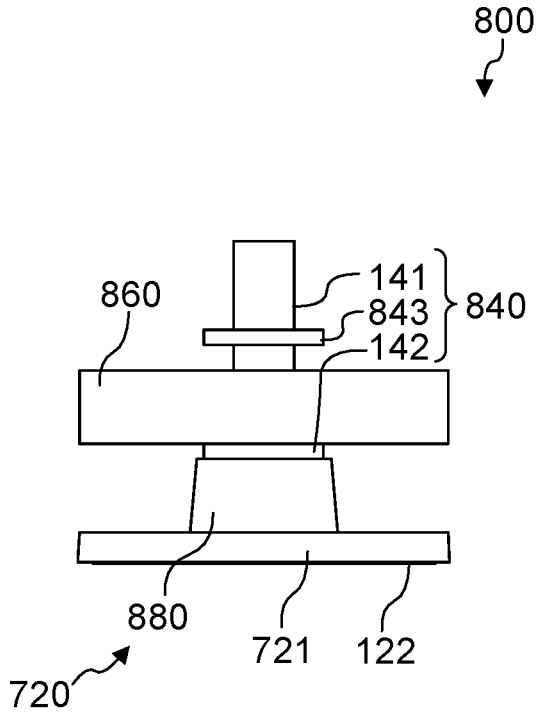
Figure 10D:
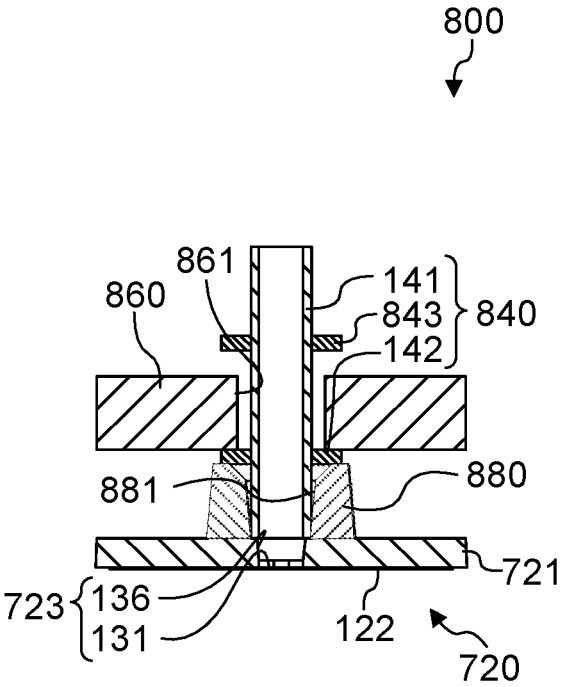

FIG. 10A is a side view of fluid handling system 800 in a state before tube 840 is inserted into opening 723. FIG. 10B is a cross-sectional view of fluid handling system 800 in the state before tube 840 is inserted into opening 723. FIG. 10C is a side view of fluid handling system 800 in a state after tube 840 is inserted into opening 723. FIG. 10D is a cross-sectional view of fluid handling system 800 in the state after tube 840 is inserted into opening 723.

As illustrated in FIGS. 10A to 10D, fluid handling system 800 includes fluid handling device 720, tube 840, support member 860, and first elastic member 880.

Fluid handling device 720 according to the present embodiment is composed of substrate 721 and film 122, and includes channel 124 and at least one opening 723. The at least one opening 723 includes introduction part 725 and discharge part 726. As introduction part 725 and discharge part 726 have the same structure, only introduction part 725 will be described.

Introduction part 725 in the present embodiment does not have first inner surface 135, step surface 137, top surface 133, or outer peripheral surface 134 as compared with introduction part 125 in embodiment 1. In other words, introduction part 725 in the present embodiment includes bottom surface 131 and second inner surface 136.

Tube 840 includes tube body 141, first flange 142, and second flange 843. In the present embodiment, first flange 142 is disposed between first through hole 861 and fluid handling device 720, and second flange 843 is disposed in such a way that first through hole 861 is located between first flange 142 and second flange 843. First flange 142 and second flange 843 have the same structure. Tube body 141, first flange 142, and second flange 843 are formed as separate bodies. The shapes of first flange 142 and second flange 843 in plan view are larger than the shape of first through hole 861 in plan view. In the present embodiment, tube body 141 is inserted into ring-shaped first flange 142 and ring-shaped second flange 843, thereby fixing first flange 142 and second flange 843 at predetermined positions on tube body 141.

Support member 860 supports tube 840. Support member 860 includes first through hole 861. In the present embodiment, first through hole 861 supports tube 840. First through hole 861 may be in any shape that can exhibit the above functions. The shape of first through hole 861 in plan view may be a circle or a polygon. In the present embodiment, first through hole 861 has a circular shape in plan view. In the present embodiment, first through hole 861 has a shape of a circular cylinder.

First elastic member 880 is fixed on the surface of substrate 721, and supports tube 840 so as to allow the movement of tube 840 (movably supports tube 840). First elastic member 880 is formed to have a cylindrical shape. First elastic member 880 may have any size that can be appropriately designed as needed. In the present embodiment, the inner diameter of the opening portion of first elastic member 880 is about 2 mm.

In the present embodiment, first elastic member 880 includes inner surface 881, top surface 882, and outer peripheral surface 883.

In the present embodiment, inner surface 881 is a tapered surface inclined in such a way that the distance of the surface from the center of first elastic member 880 decreases from the support member 860 side toward the fluid handling device 720 side. In other words, inner surface 881 has the shape of the side surface of an inverted frustum. Inner surface 881 holds the outer peripheral surface of tube body 141. Top surface 882 is disposed so as to face first flange 142. In the present embodiment, top surface 882 includes a tapered inner surface. Outer peripheral surface 883 is a tapered surface inclined in such a way that the distance of the surface from the center of inner surface 881 increases from the support member 860 side toward the fluid handling device 720 side. In other words, outer peripheral surface 883 has the shape of the side surface of a frustum.

For connecting tube 840 with opening 723 in this configuration, the outer surface of tube body 141 comes into contact with inner surface 881 of first elastic member 880, and the end surface of tube body 141 comes into contact with the surface of substrate 721. In addition, first elastic member 880 comes into close contact with first flange 142. When opening 723 is connected with tube 840, fluid leakage can be prevented because tube 840 is movable in the planar, vertical and rotational directions due to first elastic member 880, and thus tube 840 can be moved in such a way that axis A1 of opening 723 coincides with axis A2 of tube 840.

Effects

As described above, fluid handling system 800 according to the present embodiment has the same effects as fluid handling system 100 according to embodiment 1.

Embodiment 9

Configuration of Fluid Handling System

In the following, fluid handling system 900 according to embodiment 9 will be described.

Figure 11A:
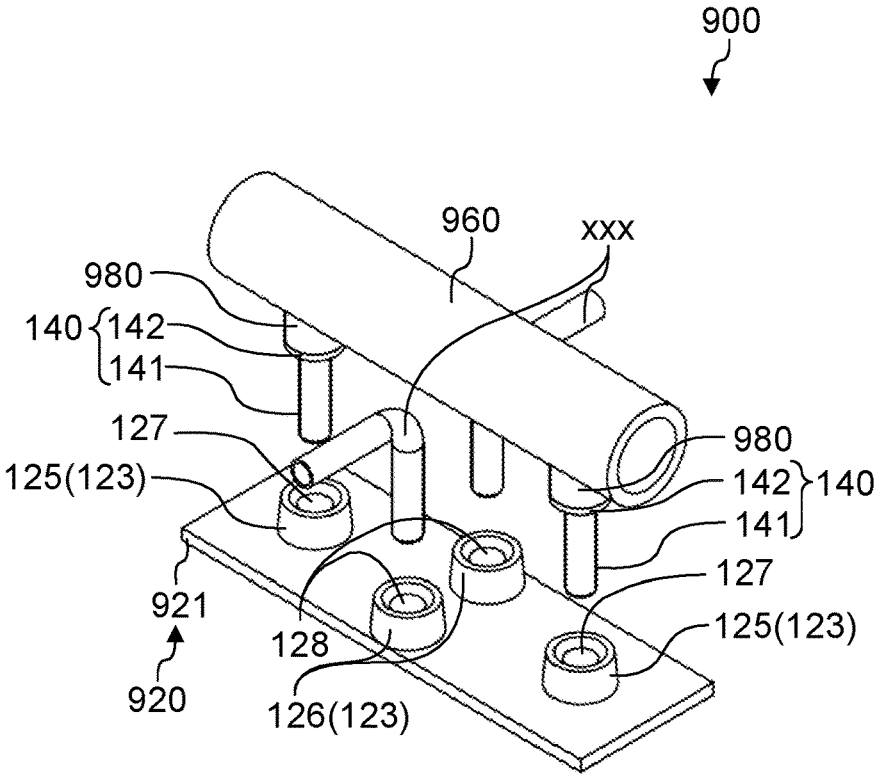
FIGS. 11A and 11B are exploded perspective views illustrating a configuration of a fluid handling system according to embodiment 9 of the present invention.
Figure 11B:
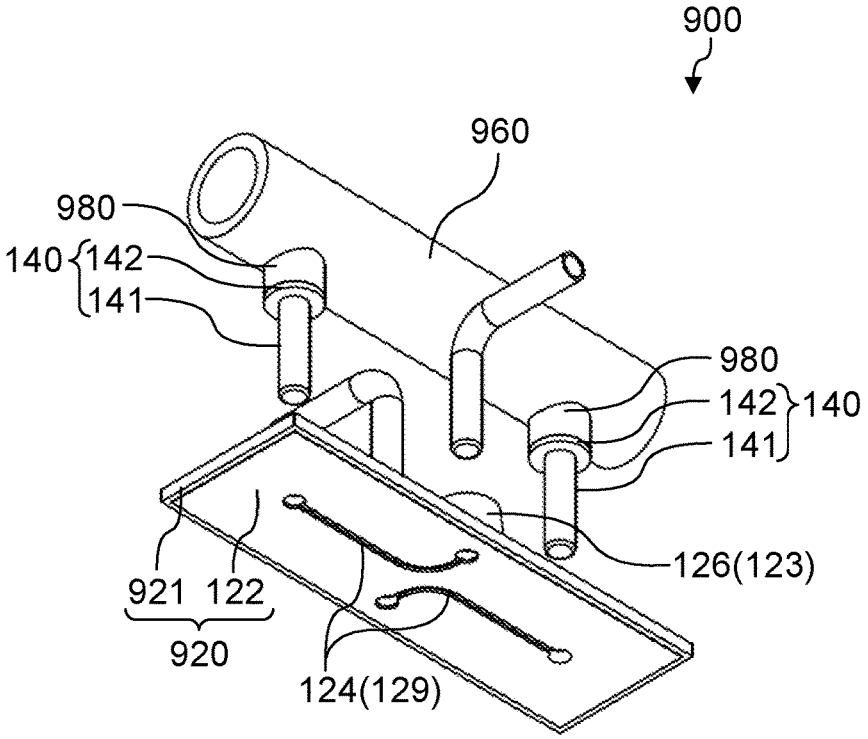
Figure 12A:
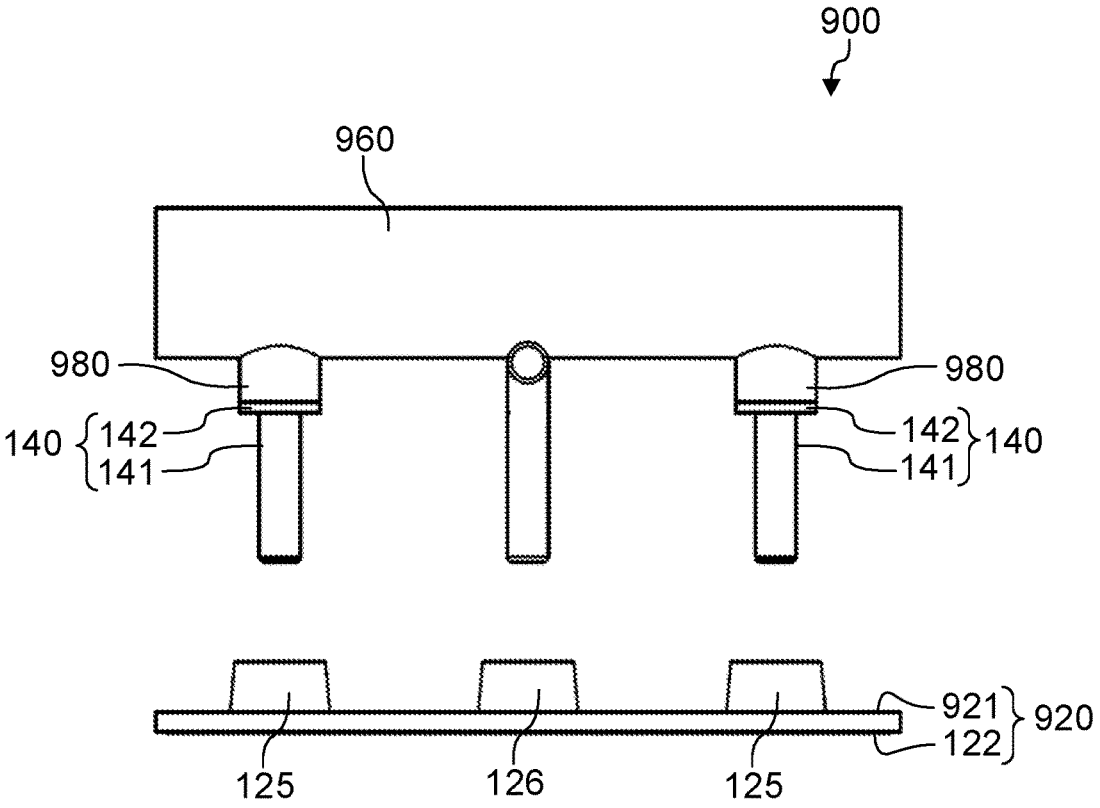
FIGS. 12A and 12B illustrate the configuration of the fluid handling system according to embodiment 9 of the present invention.
Figure 12B:
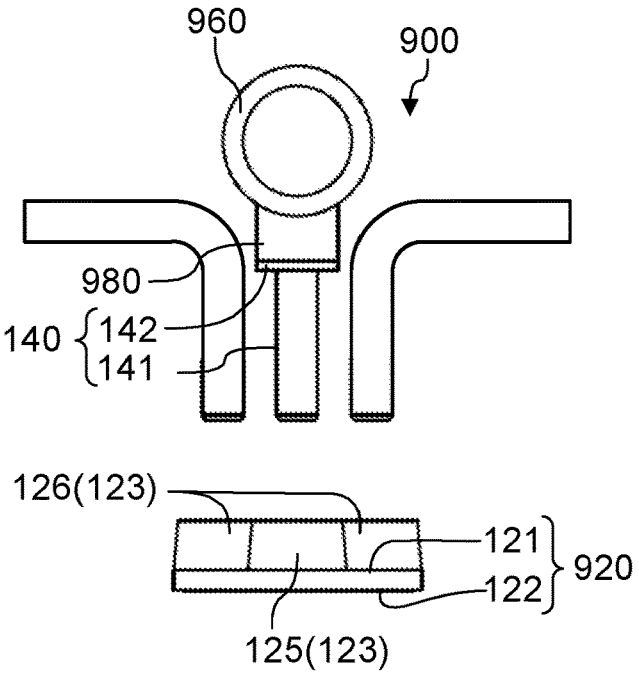
Figure 13A:
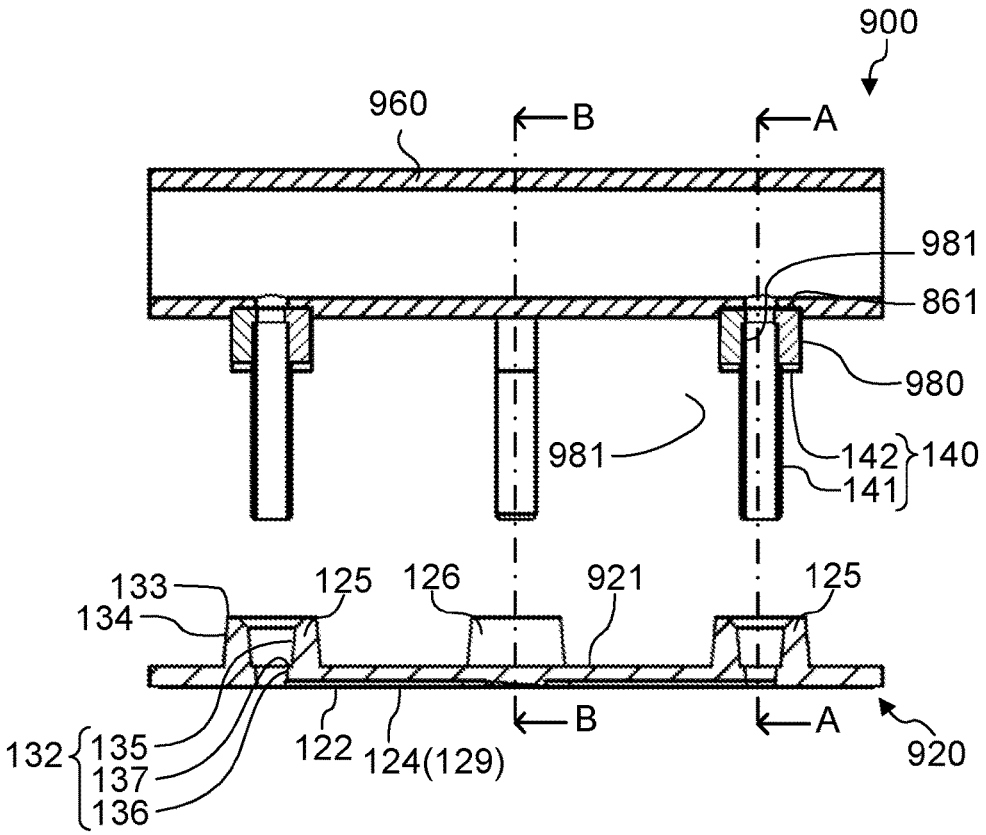
FIGS. 13A to 13C are cross-sectional views of the fluid handling system according to embodiment 9 of the present invention.
Figure 13B:
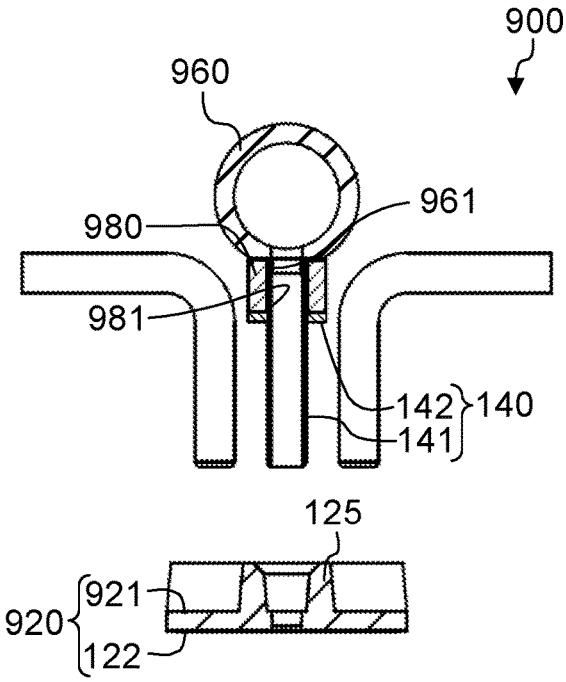
Figure 13C:
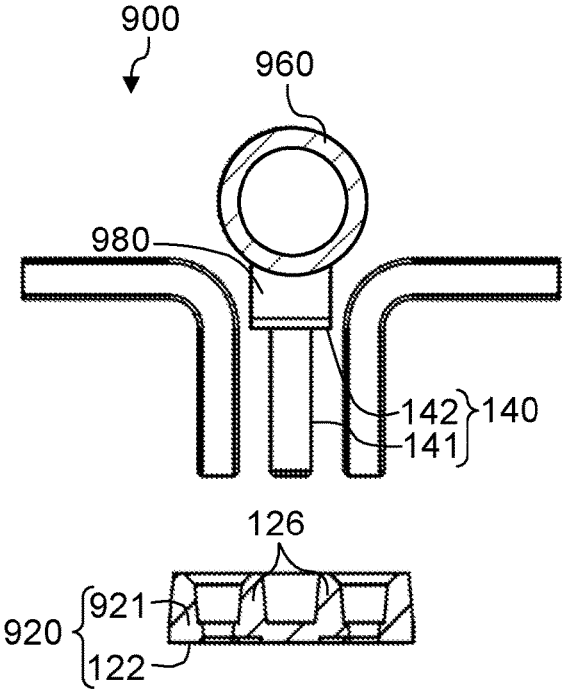
Figure 14A:
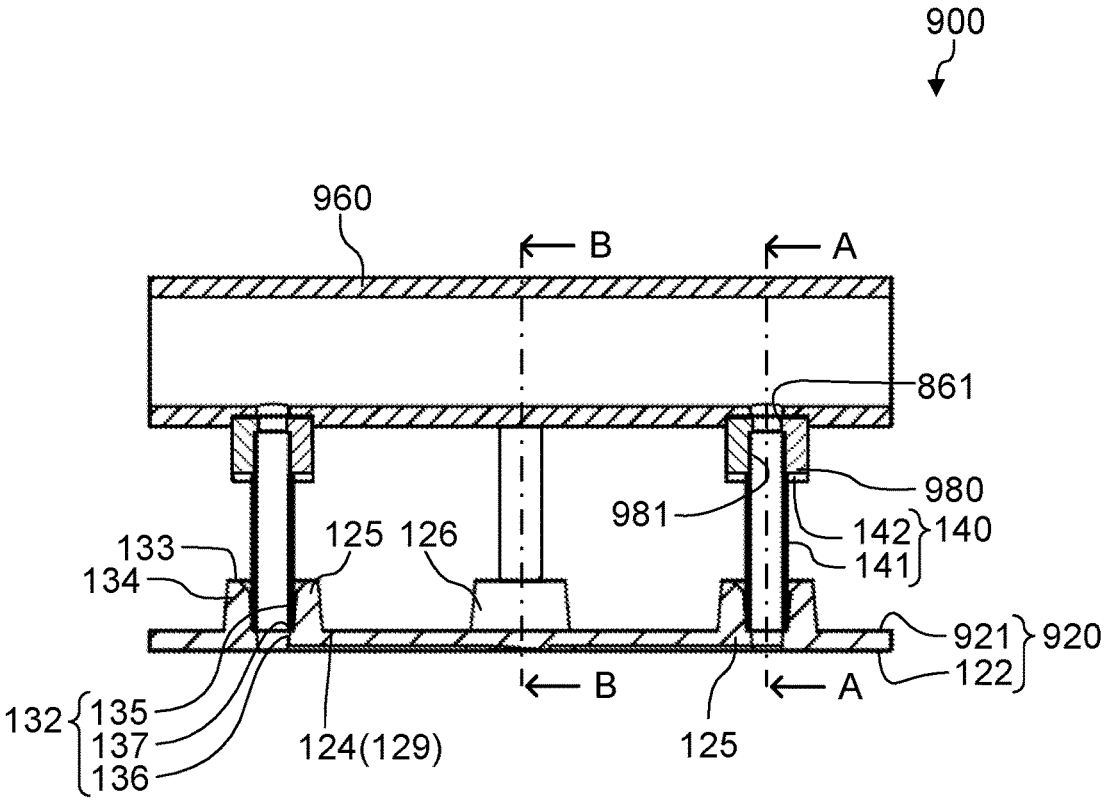
FIGS. 14A to 14C are cross-sectional views of the fluid handling system according to embodiment 9 of the present invention.
Figure 14B:
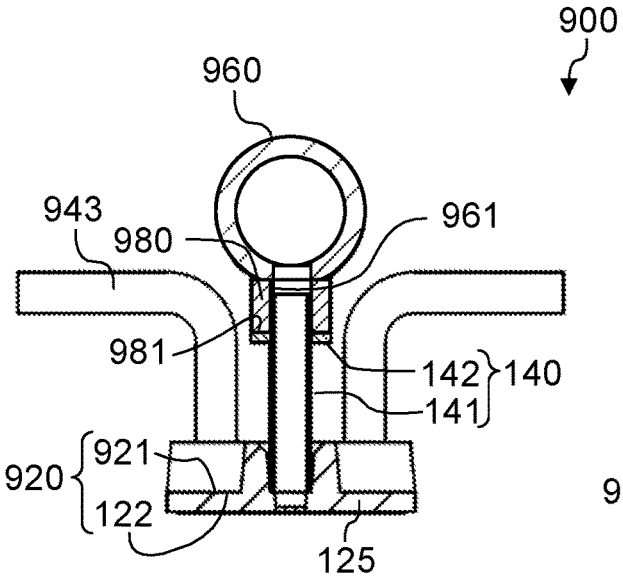
Figure 14C:
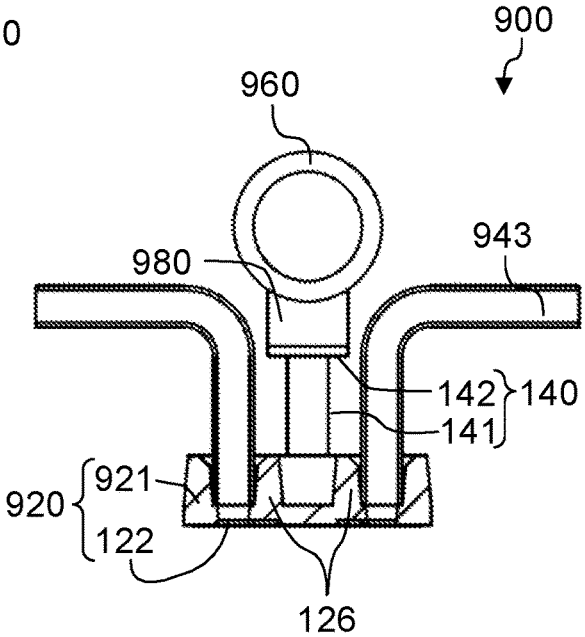

FIG. 11A is a perspective view of fluid handling system 900 as viewed from the front side thereof in a state before tubes 140 are inserted into opening 123. FIG. 11B is a perspective view of fluid handling system 900 as viewed from the back side thereof in the state before tubes 140 are inserted into opening 123. FIG. 12A is a front view of fluid handling system 900 in the state before tubes 140 are inserted into opening 123. FIG. 12B is a side view of fluid handling system 900 in the state before tubes 140 are inserted into opening 123. FIG. 13A is a cross-sectional view of fluid handling system 900 as viewed from the front thereof in the state before tubes 140 are inserted into opening 123. FIG. 13B is a cross-sectional view of fluid handling system 900, in the state before tube 140 along line A-A of FIG. 13A is inserted into opening 123, as viewed from the side thereof. FIG. 13C is a cross-sectional view of fluid handling system 900, in the state before tube 140 along line B-B of FIG. 13A is inserted into opening 123, as viewed from the side thereof. FIG. 14A is a cross-sectional view of fluid handling system 900 as viewed from the front thereof in a state after tubes 140 are inserted into opening 123. FIG. 14B is a cross-sectional view of fluid handling system 900, in the state after tube 140 along line A-A of FIG. 14A is inserted into opening 123, as viewed from the side thereof. FIG. 14C is a cross-sectional view of fluid handling system 900, in the state after tube 140 along line B-B of FIG. 14A is inserted into opening 123, as viewed from the side thereof.

As illustrated in FIGS. 11A, 11B, 12A, 12B, 13A to 13C and 14A to 14C, fluid handling system 100 includes fluid handling device 920, tube 140, support member 960, and at least one first elastic member 980.

Fluid handling device 920 according to the present embodiment is composed of substrate 921 and film 122. The regions surrounded by substrate 921 and film 122 serve as two channel 124 each for allowing a fluid to flow therethrough. Substrate 921 includes two introduction side through holes 127, two discharge side through holes 128, and two channel grooves 129. As film 122 joins to substrate 921, two introduction side through holes 127 become two introduction parts 125, two discharge side through holes 128 become two discharge parts 126, and two channel grooves 129 become two channels 124. In the present embodiment, fluid handling system 900 includes two introduction parts 125 and two discharge parts 126 as openings 123. Support member 960 with tubes 140 connected thereto is connected to introduction parts 125 by first elastic members 980. In addition, a discharge device (not shown) is connected to discharge part 126 by discharge tube 943.

In the present embodiment, first elastic member 980 includes second through hole 981. The end of tube body 141 is inserted into second through hole 981. In the present embodiment, tube body 141 does not pass through second through hole 981.

Support member 960 has a shape of a cylinder, and supports tube 140 via first elastic member 980. Support member 960 includes at least one first through hole 961. In the present embodiment, first through hole 961 supports first elastic member 980 that holds tube 140. First through hole 961 may be in any shape that can exhibit the above functions. The shape of first through hole 961 in plan view may be a circle or a polygon. In the present embodiment, first through hole 961 has a circular shape in plan view. First through hole 961 has a region, where the inner diameter of the first through hole is larger, on the fluid handling device 920 side and a region, where the inner diameter is smaller, on the side opposite to the fluid handling device 920 side. First elastic member 980 is disposed in the region on the fluid handling device 920 side where the inner diameter is larger.

Examples of the material for support member 960 include metals, resins, and hard rubber. Examples of the metals include stainless steel, aluminum, and steel. Examples of resins include polyethylene terephthalate, polycarbonate, polymethyl methacrylate, vinyl chloride, polypropylene, polyether, polyethylene, cycloolefin polymer, cycloolefin copolymer, fluororesins such as polytetrafluoroethylene (PTFE), nylon and polypolyetheretherketone (PEEK). The material of support member 960 is preferably harder than the material of first elastic member 980, and preferably has corrosion resistance as the member directly contacts with a fluid. When the material of support member 160 is metal, stainless steel is preferred.

In the present embodiment, the end of tube 140 is disposed immediately above introduction part 125 for connecting introduction part 125 (opening 123) with tube 140. Tube 140 is then inserted into introduction part 125, but axis A1 of introduction part 125 does not coincides with axis A2 of tube 140 in some cases. In other words, the axis of tube 140 may be at an angle with respect to the axis of introduction part 125. In fluid handling system 900 of the present embodiment, however, tube 140 is movable in the planar, vertical and rotational directions due to first elastic member 980, thus tube 140 can be moved in such a way that the axis of introduction part 125 coincides with the axis of tube 140. This configuration brings a part of the outer peripheral surface of tube body 141 into close contact with a part of inner surface 132 of opening 123. Tube 140 thus can be properly connected with introduction part 125 of fluid handling device 920. Therefore, fluid leakage can be prevented in fluid handling device 900 of the present embodiment. On the other hand, a discharge tube is connected to discharge part 126. The discharge tube is also connected to a discharge device (not shown).

Effects

As described above, fluid handling system 900 according to the present embodiment has the same effects as fluid handling system 100 according to embodiment 1.

Figure 15A:
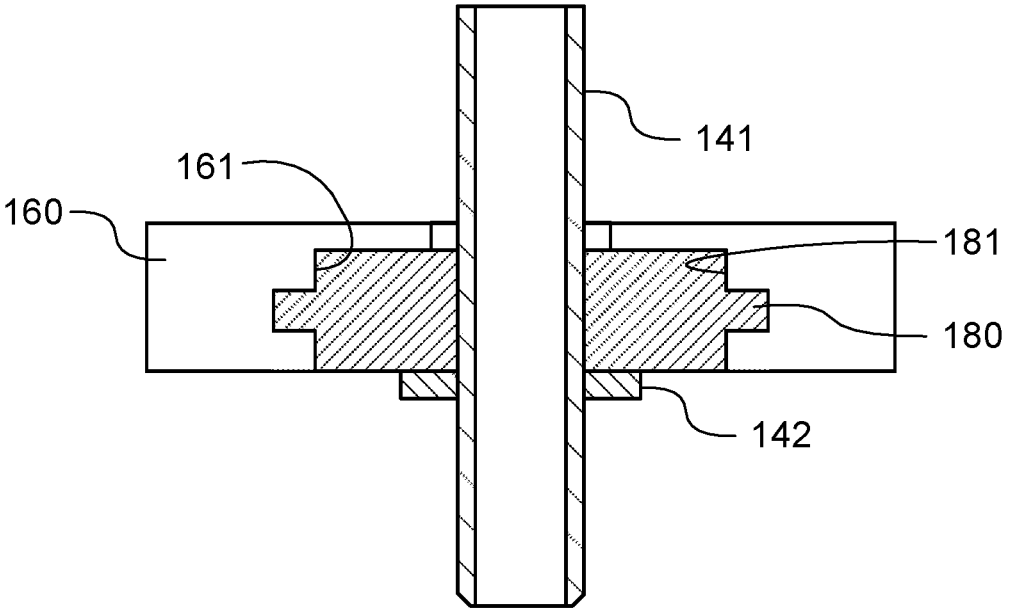
FIGS. 15A and 15B are cross-sectional views illustrating different shapes of the first through hole in the support member.
Figure 15B:
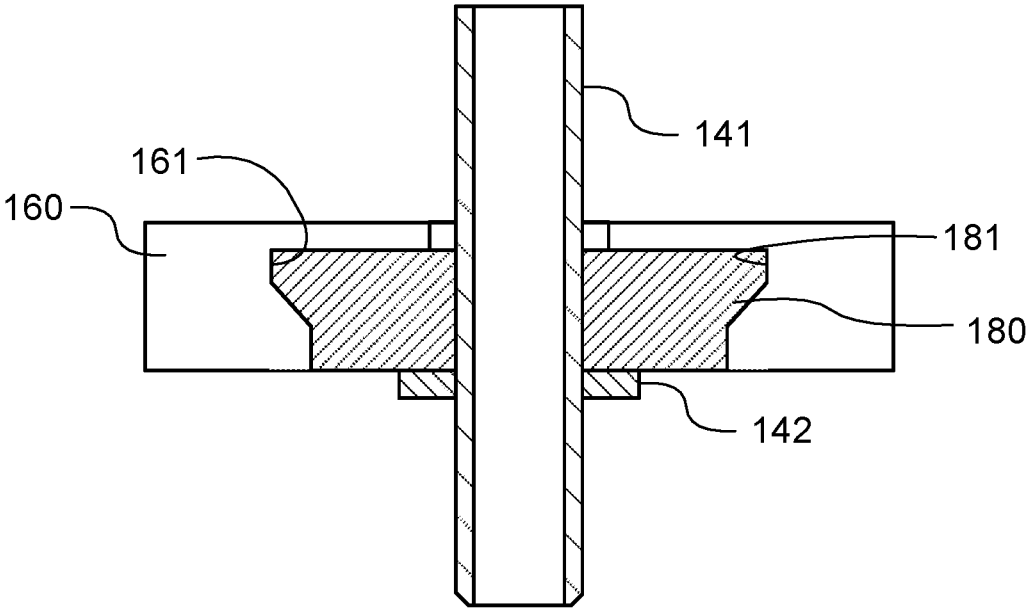

As illustrated in FIGS. 15A and 15B, first through hole 161 of support member 160 may have an undercut structure in embodiment 1. Herein, the term "undercut structure" refers to a convex or concave shape that prevents first elastic member 180 from being easily removed from support member 160. Fluid handling systems 200, 300, 400, 500, 600, 700, and 900 according to embodiments 2 to 7 and 9 may also employ such an undercut structure.

INDUSTRIAL APPLICABILITY

Fluid handling systems of the present invention are particularly advantageous in a variety of applications such as clinical tests, food tests, and environment tests.

REFERENCE SIGNS LIST

100, 200, 300, 400, 500, 600, 700, 800, 900 Fluid handling system
120, 220, 320, 720, 920 Fluid handling device
121, 221, 721, 921 Substrate
122 Film
123, 223, 723, 923 Opening
124 Channel
125, 225 725 Introduction part
126, 226, 726 Discharge part

127 Introduction side through hole
128 Discharge side through hole
129 Channel groove
131 Bottom surface
132 Inner surface
133 Top surface
134 Outer peripheral surface
135 First inner surface
136 Second inner surface
137 Step surface
140, 240, 440, 740, 840 Tube
141, 741 Tube body
142, 242 First flange
160 860, 960 Support member
161, 861, 961 First through hole
180, 880, 980 First elastic member
181, 981 Second through hole
382 Second elastic member
383 Third through hole
482, 582, 682 Third elastic member
483 Fourth through hole
782 Fourth elastic member
843 Second flange
881 Inner surface
882 Top surface
883 Outer peripheral surface
943 Discharge tube

The invention claimed is:

1. A fluid handling system, comprising:

a fluid handling device including an opening for introducing a fluid or discharging the fluid;

a tube including a flange and first and second ends, wherein the first end is for connection to the opening, and the second end is for connection to an introduction device for supplying the fluid or to a discharge device for discharging the fluid;

a support member including a first through hole and supporting the tube so as to allow movement of the tube, wherein the tube is inserted into the first through hole; and a first elastic member including a second through hole and holding a part of the tube while the first elastic member is in contact with the flange and the fluid handling device or the support member, wherein the tube is inserted into the second through hole.

2. The fluid handling system according to claim 1, wherein the first elastic member is in contact with the flange while the first elastic member is disposed in the first through hole.

3. The fluid handling system according to claim 1, further comprising:

a second elastic member disposed between the flange and the fluid handling device.

4. The fluid handling system according to claim 1, wherein:

the opening has a shape of a bottomed cylinder; and the flange is disposed so as to come into contact with an outer peripheral surface of the opening.

5. The fluid handling system according to claim 1, wherein:

the opening has a shape of a bottomed cylinder; and the fluid handling system further includes a third elastic member disposed so as to cover an outer peripheral surface and a top surface of the opening.

6. The fluid handling system according to claim 5, wherein the opening includes an inner surface that includes:

a first inner surface disposed on a side of an opening portion of the opening, a second inner surface disposed on a side of a bottom portion of the opening, and a step surface connecting the first inner surface and the second inner surface with each other, wherein the third elastic member is disposed so as to further cover the first inner surface.

7. The fluid handling system according to claim 6, wherein the third elastic member is disposed so as to further cover the step surface.

8. The fluid handling system according to claim 1, wherein:

the tube passes through the support member via the first through hole;

the flange includes a first flange and a second flange, the first flange being disposed between the first through hole and the fluid handling device, the second flange being disposed in such a way that the first through hole is located between the first flange and the second flange; and the first elastic member is disposed between the first flange and the opening.

9. The fluid handling system according to claim 1, wherein the opening includes a tapered inner surface.

* * * * *